US012631005B2

(12) United States Patent
Onodera

(10) Patent No.: US 12,631,005 B2
(45) Date of Patent: May 19, 2026

(54) DISPLAY DEVICE OF WORK MACHINE, WORK MACHINE, AND REMOTE OPERATION SYSTEM FOR WORK MACHINE

(71) Applicant: SUMITOMO HEAVY INDUSTRIES, LTD., Tokyo (JP)

(72) Inventor: Masaru Onodera, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 99 days.

(21) Appl. No.: 18/754,673

(22) Filed: Jun. 26, 2024

(65) Prior Publication Data

US 2025/0003191 A1 Jan. 2, 2025

(30) Foreign Application Priority Data

Jun. 30, 2023 (JP) ..... 2023-108227

(51) Int. Cl.
*E02F 9/20* (2006.01)
*E02F 9/26* (2006.01)

(52) U.S. Cl.
CPC ..... *E02F 9/205* (2013.01); *E02F 9/261* (2013.01)

(58) Field of Classification Search
CPC ... E02F 9/205; E02F 9/24; E02F 9/261; E02F 9/264
See application file for complete search history.

(56) References Cited

U.S. PATENT DOCUMENTS

| | | | | |
|---|---|---|---|---|
| 12,359,405 | B2 * | 7/2025 | Eguchi | F16P 3/142 |
| 2010/0060440 | A1 * | 3/2010 | Suzuki | G06V 40/16 340/435 |
| 2010/0214086 | A1 * | 8/2010 | Yoshizawa | G08G 1/166 381/56 |
| 2014/0347483 | A1 * | 11/2014 | Nakanishi | B60P 1/045 348/148 |
| 2017/0298595 | A1 * | 10/2017 | Machida | H04N 23/90 |
| 2018/0258616 | A1 * | 9/2018 | Kiyota | G06T 1/00 |
| 2019/0352885 | A1 * | 11/2019 | Kurokami | B66C 23/88 |
| 2020/0318321 | A1 * | 10/2020 | Kurokawa | G06T 3/00 |
| 2023/0160181 | A1 * | 5/2023 | Kamado | E02F 9/261 345/634 |

FOREIGN PATENT DOCUMENTS

JP 2012-058314 3/2012

* cited by examiner

*Primary Examiner* — Tyler J Lee
(74) *Attorney, Agent, or Firm* — IPUSA, PLLC

(57) ABSTRACT

A display device for use in a work machine is provided. The display device includes a controller circuit configured to: acquire image information captured by an imaging device provided in the work machine; acquire information about a sound signal acquired by each of a plurality of sound collectors provided in the work machine; and display on a display section a sound generation situation around the work machine obtained based on the information about the sound signal acquired from each of the plurality of sound collectors, the sound generation situation being superimposed on the image information.

12 Claims, 17 Drawing Sheets

DISPLAY DEVICE OF WORK MACHINE, WORK MACHINE, AND REMOTE OPERATION SYSTEM FOR WORK MACHINE

CROSS-REFERENCE TO RELATED APPLICATIONS

This application is based upon and claims priority to Japanese Patent Application No. 2023-108227, filed on Jun. 30, 2023, the entire contents of which are incorporated herein by reference.

BACKGROUND

1. Technical Field

The present disclosure relates to a display device of a work machine, a work machine, and a remote operation system for the work machine.

2. Description of Related Art

Conventionally, it has been required to appropriately provide an operator who operates a work machine with information about the surrounding environment in which the work machine is operating. For example, a technology has been proposed to calculate a degree of danger for each position outside a machine, extract sound from the position with a high degree of danger, and output the sound. This enables the operator to react in an instant to avoid dangerous situations.

SUMMARY

According to an aspect of the present disclosure, a display device for use in a work machine is provided. The display device includes a controller circuit configured to: acquire image information captured by an imaging device provided in the work machine; acquire information about a sound signal acquired by each of a plurality of sound collectors provided in the work machine; and display on a display section a sound generation situation around the work machine obtained based on the information about the sound signal acquired from each of the plurality of sound collectors, the sound generation situation being superimposed on the image information.

DETAILED DESCRIPTION

Figure 1:
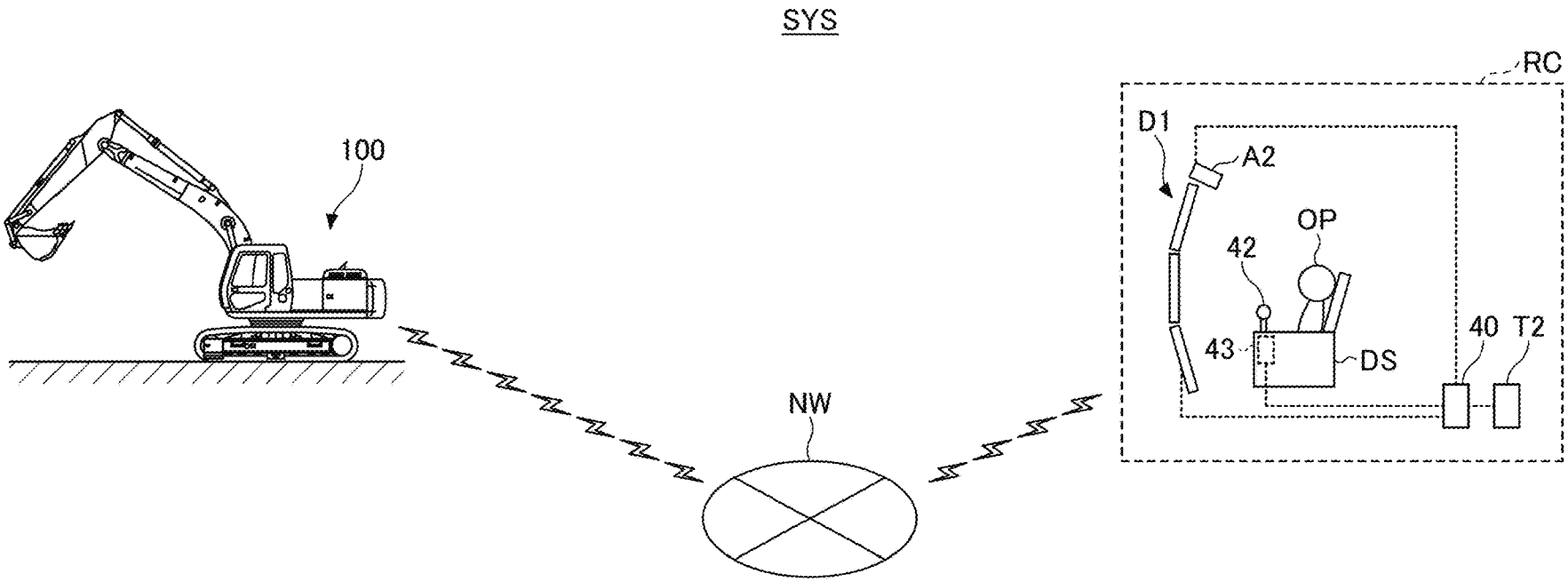
FIG. 1 is a schematic diagram illustrating an example of a remote operation system according to one embodiment.

The system described in the related art does not take into account the display of the source of the sound. Therefore, upon displaying image information representing the surroundings of a work machine, it is considered that safety can be further improved when the position of the sound source in the surroundings of the work machine can be visually recognized.

According an embodiment of the present disclosure, a sound generation situation around a work machine can be recognized by displaying a sound generation situation around a work machine superimposed on image information captured by an imaging device, thereby improving safety.

Hereinafter, embodiments of the present disclosure will be described with reference to the drawings. The embodiments described below do not limit the invention, but are illustrative examples, and not all features or combinations thereof described in the embodiments are necessarily essential to the invention. In each drawing, the same or corresponding configurations may be indicated by the same or corresponding reference numerals, and explanations thereof may be omitted.

One Embodiment

First, an outline of a remote operation system SYS according to one embodiment will be described with reference to FIG. 1. FIG. 1 is a schematic diagram illustrating an example of the remote operation system SYS according to the one embodiment.

<Devices Constituting Remote Operation System>

As illustrated in FIG. 1, the remote operation system SYS according to the one embodiment includes a shovel 100 and a remote operation room RC.

The shovel 100 and the remote operation room RC are connected to enable data transmission and reception via a communication line NW.

The shovel 100 is capable of wireless communication. The shovel 100 can send and receive data to and from a device (for example, the remote operation room RC) connected to the communication line NW.

The shovel 100 transmits information about a work site to the remote operation room RC. This allows the remote operation room RC to check the work site in response to the information from the shovel 100. In the present embodiment, the device for measuring the work site is not limited to the shovel 100, but may be any other type of device, such as a drone that flies over the work site, a fixed point camera, or an imaging device that can be carried by a user.

For example, the shovel 100 is provided with an imaging device S6. The shovel 100 transmits imaging information indicating imaging results of the work site by the imaging device S6 to the remote operation room RC.

The number of shovels 100 included in the remote operation system SYS may be one or more. The remote operation system SYS can provide information about the work site to the remote operation room RC through the plurality of shovels 100.

<Configuration Example of Remote Operation Room>

The remote operation room RC includes a communication device T2, a remote controller 40, an operation device 42, an operation sensor 43, a display device D1, and a speaker A2. The remote operation room RC includes an operation seat DS on which an operator OP who remotely operates the shovel 100 sits.

The communication device T2 is configured to control communication with a communication device T1 (see FIG. 2) attached to the shovel 100.

The remote controller 40 is an information processing device that performs various calculations. In the present embodiment, the remote controller 40 is composed of a microcomputer including a CPU and a memory. Various functions of the remote controller 40 are implemented by the CPU executing a program stored in the memory.

The display device D1 displays a screen based on information transmitted from the shovel 100 in order for the operator OP in the remote operation room RC to view the surroundings of the shovel 100. According to the display device D1, the operator can check the situation of the work site including the surroundings of the shovel 100 while staying in the remote operation room RC.

The operation device 42 is provided with an operation sensor 43 for detecting details of operations of the operation device 42. The operation sensor 43 is, for example, an inclination sensor for detecting an inclination angle of an operation lever, an angle sensor for detecting a swing angle around the swing axis of the operation lever, or the like. The operation sensor 43 may include other sensors such as a pressure sensor, a current sensor, a voltage sensor, or a distance sensor. The operation sensor 43 outputs information regarding the detected details of operations of the operation device 42 to the remote controller 40. The remote controller 40 generates an operation signal based on the received information and transmits the generated operation signal to the shovel 100. The operation sensor 43 may be configured to generate the operation signal. In this case, the operation sensor 43 may output the operation signal to the communication device T2 without going through the remote controller 40. Thereby, the remote operation of the shovel 100 can be achieved from the remote operation room RC.

The speaker A2 outputs sound information transmitted from the shovel 100 so that the operator OP in the remote operation room RC can recognize the sound generated around the shovel 100.

<Configuration Example of Shovel>

Figure 2:
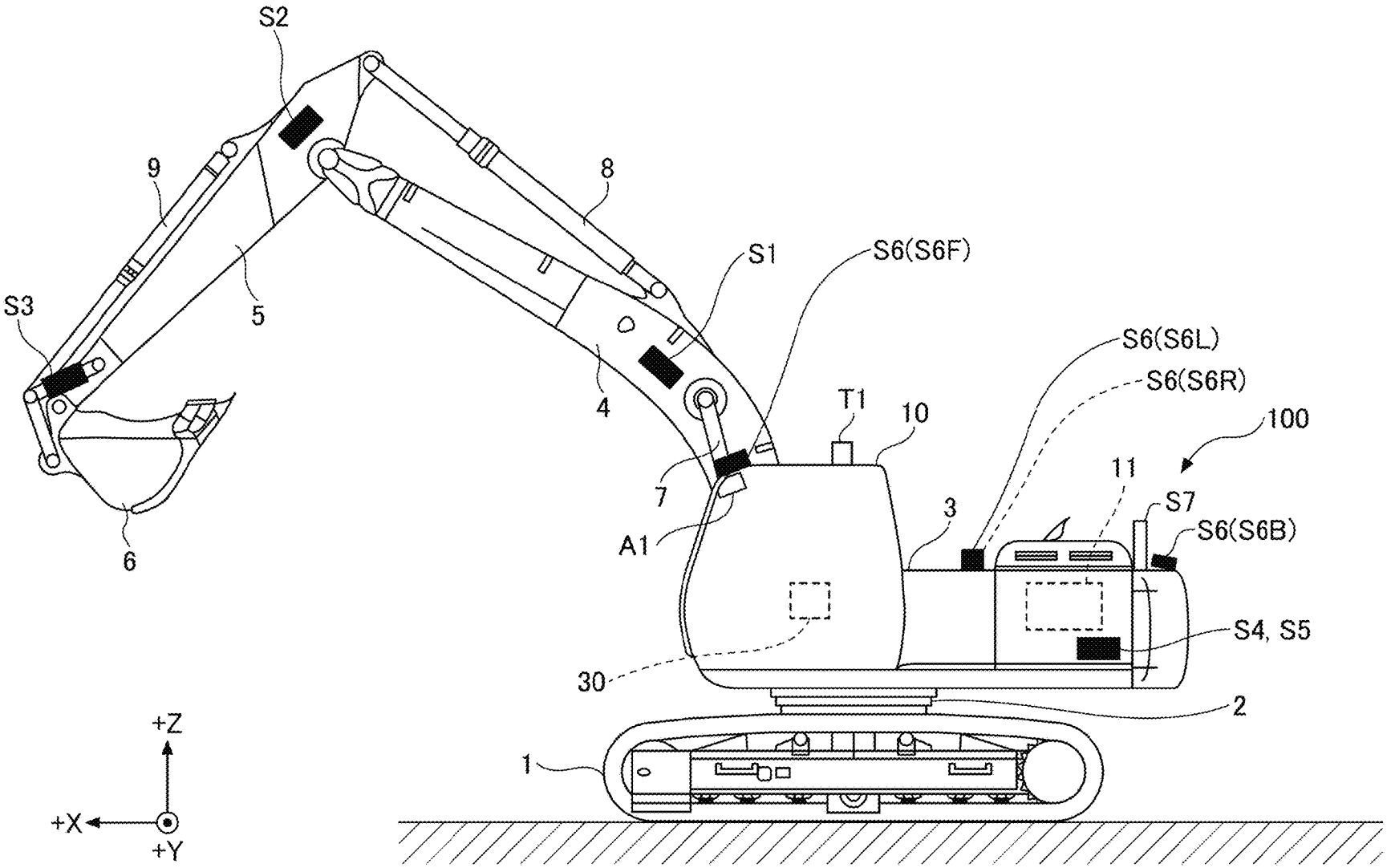
FIG. 2 is a side view illustrating a shovel (an excavator) according to the one embodiment.

Next, an overview of the shovel 100 according to the present embodiment will be described with reference to FIG. 2. FIG. 2 is a side view of the shovel 100 as a work machine according to the one embodiment. An upper turning body 3 is rotatably mounted on a lower traveling body 1 of the shovel 100 via a turning mechanism 2. A boom 4 is attached to the upper turning body 3. An arm 5 is attached to the tip of the boom 4, and a bucket 6 as an end attachment is attached to the tip of the arm 5. The end attachment may be a slope bucket, a dredging bucket, or the like.

In the example illustrated in FIG. 2, the traveling direction (forward and backward direction) of the shovel 100 is indicated by the X axis, the width direction of the shovel 100 is indicated by the Y axis, and the height direction of the shovel 100 is indicated by the Z axis.

The boom 4, the arm 5, and the bucket 6 constitute an excavation attachment that is an example of an attachment, and are hydraulically driven by a boom cylinder 7, an arm cylinder 8, and a bucket cylinder 9, respectively. A boom angle sensor S1 is attached to the boom 4, an arm angle sensor S2 is attached to the arm 5, and a bucket angle sensor S3 is attached to the bucket 6. The excavation attachment may be provided with a bucket tilt mechanism.

The boom angle sensor S1 detects the rotation angle of the boom 4. In the present embodiment, the boom angle sensor S1 is an acceleration sensor and can detect the boom angle that is the rotation angle of the boom 4 with respect to the upper turning body 3. For example, the boom angle becomes the minimum angle when the boom 4 is lowered the most, and increases as the boom 4 is raised.

The arm angle sensor S2 detects the rotation angle of the arm 5. In the present embodiment, the arm angle sensor S2 is an acceleration sensor and can detect the arm angle that is the rotation angle of the arm 5 with respect to the boom 4. For example, the arm angle becomes the minimum angle when the arm 5 is most closed, and increases as the arm 5 is opened.

The bucket angle sensor S3 detects the rotation angle of the bucket 6. In the present embodiment, the bucket angle sensor S3 is an acceleration sensor and can detect the bucket angle that is the rotation angle of the bucket 6 with respect to the arm 5. For example, the bucket angle becomes the minimum angle when the bucket 6 is most closed, and increases as the bucket 6 is opened.

Each of the boom angle sensor S1, the arm angle sensor S2, and the bucket angle sensor S3 may be a potentiometer using a variable resistor, a stroke sensor that detects the stroke amount of the corresponding hydraulic cylinder, a rotary encoder that detects the rotation angle around the connecting pin, or the like. The boom angle sensor S1, the arm angle sensor S2, and the bucket angle sensor S3 constitute an attitude sensor that detects the attitude of the excavation attachment.

The upper turning body 3 is equipped with a cabin 10 as a driver's cabin, an engine 11, a body inclination sensor S4, a turning angular velocity sensor S5, an imaging device S6, a positioning device S7, a microphone array A1, a communication device T1, and the like.

A shovel controller 30 is installed in the cabin 10. A driver's seat, an operation device, and the like are installed in the cabin 10.

The shovel controller 30 is a calculation device that performs various calculations. The shovel controller 30 is provided in the cabin 10, for example, and controls the drive of the shovel 100. The function of the shovel controller 30 may be implemented by any hardware, software, or combination thereof. For example, the shovel controller 30 is composed mainly of a microcomputer including a memory device such as a central processing unit (CPU) and a random access memory (RAM); a non-volatile auxiliary storage device such as a read only memory (ROM); various input/output interface devices; and the like. The shovel controller 30 performs various functions by, for example, executing various programs installed in the non-volatile auxiliary storage device on the CPU.

The engine 11 is a driving source of the shovel 100. In the present embodiment, the engine 11 is a diesel engine. The output shaft of the engine 11 is coupled to the respective input shafts of a main pump 14 and a pilot pump 15.

The body inclination sensor S4 is configured to detect the inclination of the upper turning body 3 with respect to a predetermined plane. In the present embodiment, the body inclination sensor S4 is an acceleration sensor that detects the inclination angle around the front-rear axis and the inclination angle around the left-right axis of the upper turning body 3 with respect to the horizontal plane. The front-rear axis and the left-right axis of the upper turning body 3 pass through the center point of the shovel, which is a point on the turning axis of the shovel 100, orthogonal to each other, for example.

The turning angular velocity sensor S5 is configured to detect the turning angular velocity of the upper turning body 3. In the present embodiment, the turning angular velocity sensor S5 is a gyro sensor. The turning angular velocity sensor S5 may be a resolver, a rotary encoder, or the like. The turning angular velocity sensor S5 may detect the turning velocity. The turning velocity may be calculated from the turning angular velocity.

The imaging device S6 is configured to acquire an image around the shovel 100. In the present embodiment, the imaging device S6 includes a front camera S6F for imaging the space in front of the shovel 100, a left camera S6L for imaging the space to the left of the shovel 100, a right camera S6R for imaging the space to the right of the shovel 100, and a rear camera S6B for imaging the space behind the shovel 100.

The imaging device S6 is, for example, a monocular camera having an imaging element such as a CCD or CMOS, and may output the captured image to a display device D1.

The front camera S6F is, for example, mounted on the roof of the cabin 10. The left camera S6L is mounted on the left end of the upper surface of the upper turning body 3. The right camera S6R is mounted on the right end of the upper surface of the upper turning body 3. The rear camera S6B is mounted on the rear end of the upper surface of the upper turning body 3.

In the present embodiment, by providing the imaging device S6 in the above-described arrangement, an object present around the shovel 100 can be imaged. As the imaging device S6, a camera (for example, RGBD cameras or stereo cameras) capable of recognizing the distance to the imaging object may be used.

The positioning device S7 is configured to acquire information about the position of the shovel 100. In the present embodiment, the positioning device S7 is configured to measure the position and orientation of the shovel 100 in the reference coordinate system. Specifically, the positioning device S7 is a GNSS receiver incorporating an electronic compass and measures the latitude, longitude, and altitude of the current position of the shovel 100 and the orientation of the shovel 100. The reference coordinate system according to the present embodiment is, for example, a world geodetic system. The world geodetic system is a three-dimensional orthogonal XYZ coordinate system in which the origin is placed at the center of gravity of the earth, the X-axis is taken in the direction of the intersection of the Greenwich meridian and the equator, the Y-axis is taken in the direction of 90 degrees east longitude, and the Z-axis is taken in the direction of the north pole.

The communication device T1 is configured to control communication with equipment outside the shovel 100. In the present embodiment, the communication device T1 is configured to control communication between the communication device T1 and equipment outside the shovel 100 via a wireless communication network. The communication device T1 includes, for example, a mobile communication module corresponding to a mobile communication standard such as long term evolution (LTE), 4th generation (4G), and 5th generation (5G), a satellite communication module for connection to a satellite communication network, or the like.

The communication device T1 controls, for example, wireless communication between the external global navigation satellite system (GNSS) positioning system and the shovel 100.

The microphone array A1 has a plurality of microphones and is configured to collect sounds generated around the shovel 100. In the present embodiment, the microphone array A1 is a plurality of microphones attached to the upper turning body 3.

Figure 3:
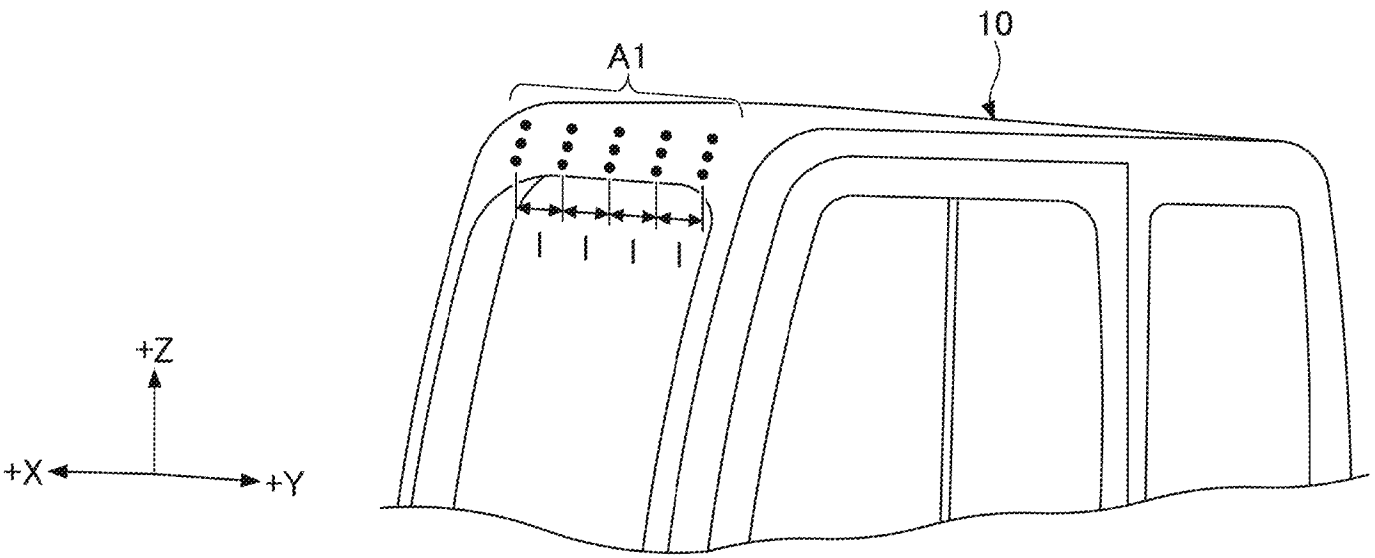
FIG. 3 is a diagram illustrating an arrangement example of microphones included in a microphone array provided on the shovel according to the one embodiment.

FIG. 3 is a diagram illustrating an arrangement example of microphones included in the microphone array A1 according to the present embodiment. As illustrated in FIG. 3, the microphone array A1 is provided on the front side of the cabin 10. Specifically, a total of 15 microphones constituting the microphone array A1 are arranged in 3 times 5 array, with three microphones in the Z-axis direction and five microphones in the Y-axis direction. The distance between the microphones constituting the microphone array A1 is a distance l. The distance between the microphones is illustrated as an example and is determined depending on the implementation.

Each of the microphones constituting the microphone array A1 is capable of collecting sound in a predetermined direction within a range of −90 degrees to +90 degrees centered on the front, for example. The range in which the microphone array A1 can acquire sounds is determined so as to be able to acquire at least the sounds emitted within the imaging range of the front camera S6F. Thereby, when displaying the image information captured by the front camera S6F, the sound emitted in the imaging range can be displayed in a recognizable manner. The display manner of the image information will be described later. In the present embodiment, the sound collection range of the microphone array A1 is illustrated as an example, and it is sufficient that it includes at least the imaging range of the front camera S6F.

In the present embodiment, an example using the microphone array A1 illustrated in FIG. 3 has been described as an example of a plurality of sound collectors. The present embodiment describes an example of a plurality of sound collectors and is not limited to the microphone array A1 illustrated in FIG. 3. Specifically, the number of the microphones is not limited to 15 (3 times 5) illustrated in FIG. 3. For example, the number of the microphones in the width direction (Y-axis direction) may be other than five, and the number of the microphones in the height direction (Z-axis direction) may be other than three. In addition, the number of the microphones is not limited to a two-dimensional array in the Y-axis direction and the Z-axis direction, and may be, for example, a one-dimensional array in the Y-axis direction.

[Drive Control System of Shovel]

Figure 4:
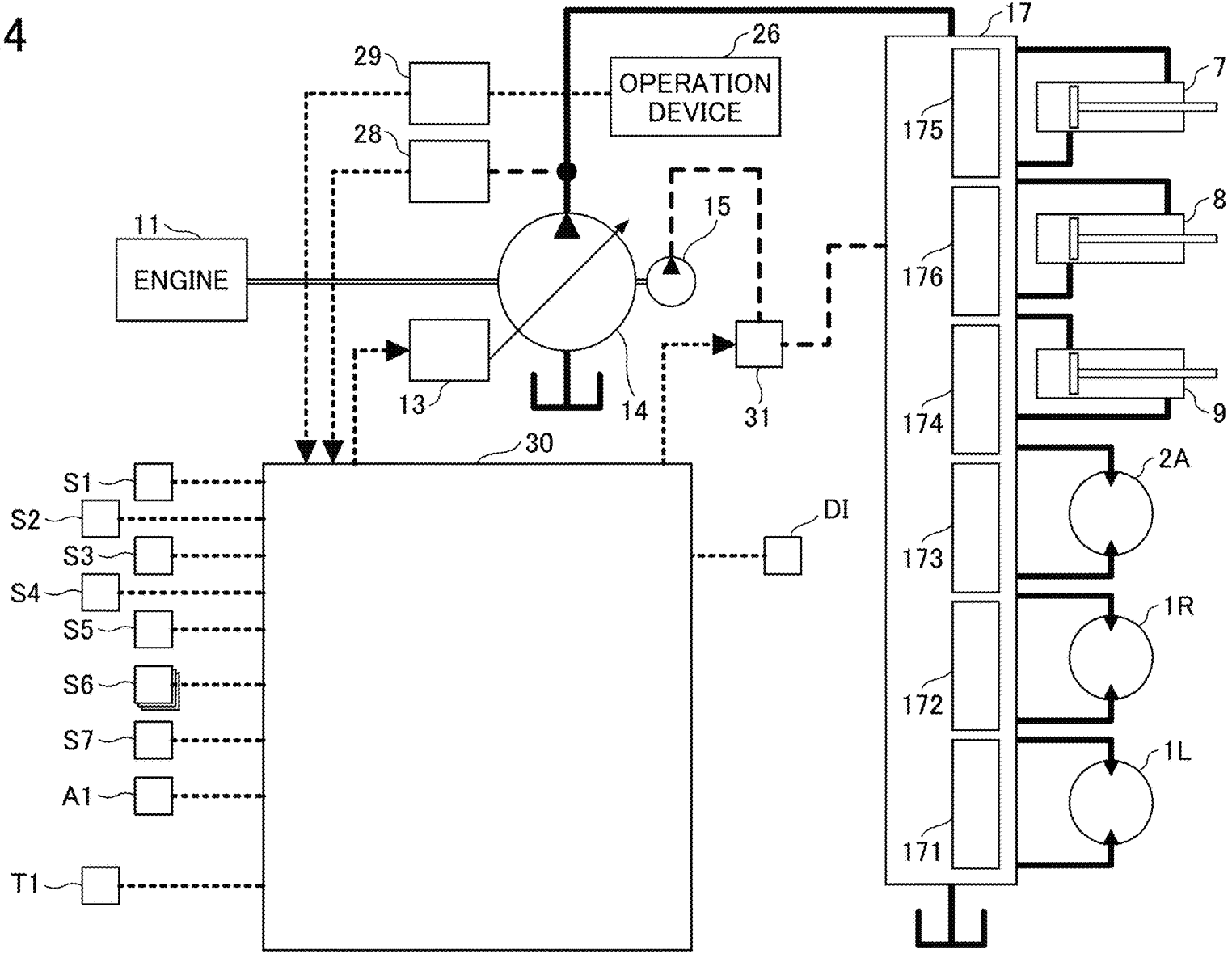
FIG. 4 is a diagram illustrating a configuration example of a drive control system of the shovel according to the one embodiment.

FIG. 4 is a diagram illustrating a configuration example of a drive control system of the shovel 100 illustrated in FIG. 2. In FIG. 4, a mechanical power transmission system is indicated by a double line, hydraulic fluid lines are indicated by thick solid lines, pilot lines are indicated by dashed lines, and electric drive and control system is indicated by dotted lines.

The drive system of the shovel 100 according to the present embodiment includes the engine 11, a regulator 13, the main pump 14, and a control valve unit 17. As described above, the hydraulic drive system of the shovel 100 according to the present embodiment includes hydraulic actuators such as traveling hydraulic motors 1L and 1R, a turning hydraulic motor 2A, the boom cylinder 7, the arm cylinder 8, and the bucket cylinder 9, for hydraulically driving the lower traveling body 1, the upper turning body 3, the boom 4, the arm 5, and the bucket 6, respectively.

The engine 11 is the main power source in the hydraulic drive system and is mounted, for example, at the rear of the upper turning body 3. Specifically, the engine 11 rotates at a predetermined target rotational speed under direct or indirect control by the shovel controller 30 described later, to drive the main pump 14 and the pilot pump 15. The engine 11 is, for example, a diesel engine using light oil as fuel.

The regulator 13 controls the discharge amount of the main pump 14. For example, the regulator 13 adjusts the angle (tilting angle) of the swash plate of the main pump 14 in response to a control command from the shovel controller 30. The regulator 13 includes, for example, regulators 13L and 13R as described later.

The main pump 14 is mounted, for example, at the rear of the upper turning body 3, like the engine 11, and supplies hydraulic fluid to the control valve unit 17 through a high-pressure hydraulic line. The main pump 14 is driven by the engine 11 as described above. The main pump 14 is, for example, a variable displacement hydraulic pump. As described above, the stroke length of the piston is adjusted by adjusting the tilting angle of the swash plate by the regulator 13 under the control of the shovel controller 30, and the discharge flow rate (discharge pressure) is controlled. The main pump 14 includes, for example, main pumps 14L and 14R as described below.

The control valve unit 17 is a hydraulic control device that controls the hydraulic system in the shovel 100. In the present embodiment, the control valve unit 17 includes control valves 171 to 176. The control valve 175 includes a control valve 175L and a control valve 175R, and the control valve 176 includes a control valve 176L and a control valve 176R. The control valve unit 17 is configured to selectively supply hydraulic fluid discharged from the main pump 14 to one or more hydraulic actuators through the control valves 171 to 176. The control valves 171 to 176 control, for example, the flow rate of the hydraulic fluid flowing from the main pump 14 to the hydraulic actuator, and the flow rate of the hydraulic fluid flowing from the hydraulic actuator to the hydraulic fluid tank. The hydraulic actuator includes the boom cylinder 7, the arm cylinder 8, the bucket cylinder 9, the traveling hydraulic motors 1L and 1R, and the turning hydraulic motor 2A. More specifically, the control valve 171 corresponds to the left traveling hydraulic motor 1L, the control valve 172 corresponds to the right traveling hydraulic motor 1R, and the control valve 173 corresponds to the turning hydraulic motor 2A. The control valve 174 corresponds to the bucket cylinder 9, the control valve 175 corresponds to the boom cylinder 7, and the control valve 176 corresponds to the arm cylinder 8. The control valve 175 includes, for example, control valves 175L and 175R as described later, and the control valve 176 includes, for example, control valves 176L and 176R as described later. Details of the control valves 171 to 176 will be described later.

The pilot pump 15 is an example of a pilot pressure generation device, and is configured to be able to supply hydraulic fluid to hydraulic control devices via the pilot lines. In the present embodiment, the pilot pump 15 is a fixed capacity hydraulic pump. The pilot pressure generation device may be implemented by the main pump 14. That is, the main pump 14 may have a function of supplying the hydraulic fluid to the control valve unit 17 via the hydraulic fluid lines as well as a function of supplying the hydraulic fluid to various hydraulic control devices via the pilot lines. In this case, the pilot pump 15 may be omitted.

The operation device 26 is a device used by an operator for operating an actuator. The actuator includes at least one of a hydraulic actuator or an electric actuator.

A discharge pressure sensor 28 is configured to detect the discharge pressure of the main pump 14. In the present embodiment, the discharge pressure sensor 28 outputs the detected value to the shovel controller 30. The discharge pressure sensor 28 includes, for example, discharge pressure sensors 28L and 28R as described later.

An operation sensor 29 is configured to detect details of operations performed by the operator using the operation device 26. In the present embodiment, the operation sensor 29 detects the operation direction and the operation amount of the operation device 26 corresponding to each of the actuators, and outputs the detected values to the shovel controller 30. In the present embodiment, the shovel controller 30 controls the opening area of a proportional valve 31 depending on the output of the operation sensor 29. The shovel controller 30 then supplies the hydraulic fluid discharged by the pilot pump 15 to a pilot port of the corresponding control valve in the control valve unit 17. The pressure (pilot pressure) of the hydraulic fluid supplied to each of the pilot ports is, in principle, a pressure that corresponds to the operation direction and operation amount of the operation device 26 corresponding to each of the hydraulic actuators. Thus, the operation device 26 is configured to supply the hydraulic fluid discharged by the pilot pump 15 to the pilot port of the corresponding control valve in the control valve unit 17.

The proportional valve 31 that functions as a control valve for machine control, is arranged in a pipeline connecting the pilot pump 15 and the pilot port of the control valve in the control valve unit 17, and is configured to change the flow passage area of the pipeline. In the present embodiment, the proportional valve 31 operates in response to a control command output by the shovel controller 30. Therefore, the shovel controller 30 can supply the hydraulic fluid discharged by the pilot pump 15 to the pilot port of the control valve in the control valve unit 17 via the proportional valve 31, independently of the operation of the operation device 26 by the operator.

With this configuration, the shovel controller 30 can operate the hydraulic actuator corresponding to the specific operation device 26 even when no operation is performed on the specific operation device 26.

For example, the shovel controller 30 sets a target rotation speed based on a work mode or the like that is set in advance by a predetermined operation by the operator or the like, and performs drive control to rotate the engine 11 at a constant speed.

For example, the shovel controller 30 outputs a control command to the regulator 13 as necessary, and changes the discharge amount of the main pump 14.

For example, the shovel controller 30 controls, for example, a machine guidance function that guides a manual operation of the shovel 100 by the operator using the operation device 26. The shovel controller 30 controls, for example, a machine control function that automatically supports a manual operation of the shovel 100 by the operator using the operation device 26.

Some of the functions of the shovel controller 30 may be achieved by other controllers (control devices). That is, the functions of the shovel controller 30 may be achieved in a distributed manner by a plurality of controllers. For example, the machine guidance function and the machine control function may be achieved by a dedicated controller (control device).

[Hydraulic System of Shovel]

Next, a hydraulic system of the shovel 100 according to the present embodiment will be described with reference to FIG. 5.

Figure 5:
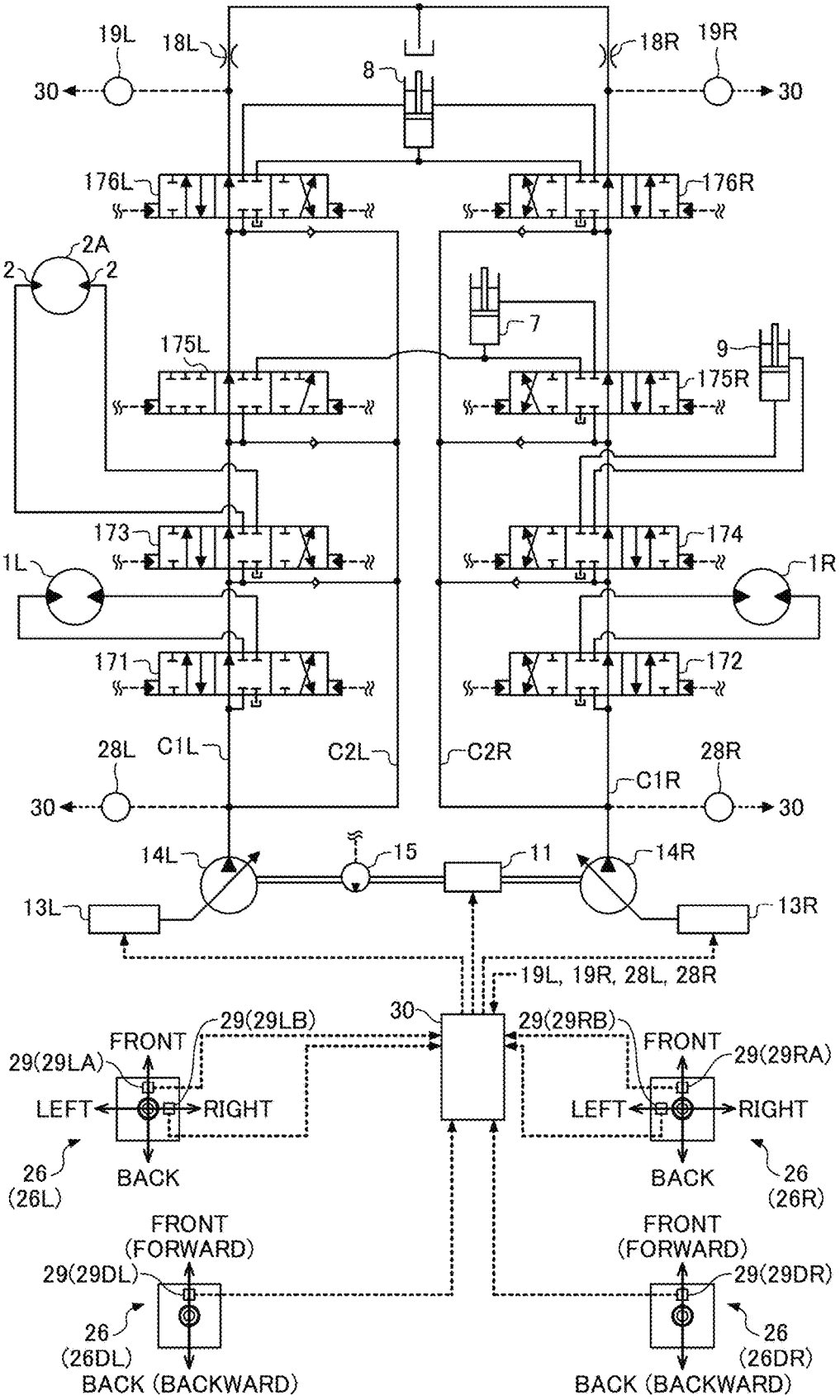
FIG. 5 is a diagram schematically illustrating an example of a configuration of a hydraulic system of the shovel according to the one embodiment.

FIG. 5 is a diagram schematically illustrating an example of a configuration of the hydraulic system of the shovel 100 according to the present embodiment.

In FIG. 5, a mechanical power system, hydraulic fluid lines, pilot lines, and an electrical control system are indicated by double lines, solid lines, dashed lines, and dotted lines, respectively.

In the hydraulic system implemented by the hydraulic circuit, the hydraulic fluid is circulated from each of the main pumps 14L and 14R driven by the engine 11 to the hydraulic fluid tank via center bypass oil passages C1L and C1R, and parallel oil passages C2L and C2R, respectively.

The center bypass oil passage C1L starts from the main pump 14L, passes through the control valves 171, 173, 175L, and 176L arranged in the control valve unit 17 in this order, and reaches the hydraulic fluid tank.

The center bypass oil passage C1R starts from the main pump 14R, passes through the control valves 172, 174, 175R, and 176R arranged in the control valve unit 17 in this order, and reaches the hydraulic fluid tank.

The control valve 171 is a spool valve for supplying the hydraulic fluid discharged from the main pump 14L to the traveling hydraulic motor 1L and discharging the hydraulic fluid discharged from the traveling hydraulic motor 1L to the hydraulic fluid tank.

The control valve 172 is a spool valve for supplying the hydraulic fluid discharged from the main pump 14R to the traveling hydraulic motor 1R and discharging the hydraulic fluid discharged from the traveling hydraulic motor 1R to the hydraulic fluid tank.

The control valve 173 is a spool valve for supplying the hydraulic fluid discharged from the main pump 14L to the turning hydraulic motor 2A and discharging the hydraulic fluid discharged from the turning hydraulic motor 2A to the hydraulic fluid tank.

The control valve 174 is a spool valve for supplying the hydraulic fluid discharged from the main pump 14R to the bucket cylinder 9 and discharging the hydraulic fluid in the bucket cylinder 9 to the hydraulic fluid tank.

The control valves 175L and 175R are spool valves for supplying the hydraulic fluids discharged from the main pumps 14L and 14R, respectively, to the boom cylinder 7 and discharging the hydraulic fluid in the boom cylinder 7 to the hydraulic fluid tank.

The control valves 176L and 176R supply the hydraulic fluids discharged from the main pumps 14L and 14R to the arm cylinder 8 and discharging the hydraulic fluid in the arm cylinder 8 to the hydraulic fluid tank.

Each of the control valves 171, 172, 173, 174, 175L, 175R, 176L, and 176R adjusts the flow rate of the hydraulic fluid supplied to and discharged from the hydraulic actuator or switches the flow direction, depending on the pilot pressure acting on the pilot port.

The parallel oil passage C2L supplies the hydraulic fluid of the main pump 14L to the control valves 171, 173, 175L, and 176L in parallel with the center bypass oil passage C1L. Specifically, the parallel oil passage C2L branches from the center bypass oil passage C1L on the upstream of the control valve 171, and is configured to be able to supply the hydraulic fluid of the main pump 14L to each of the control valves 171, 173, 175L, and 176R in parallel. Accordingly, the parallel oil passage C2L can supply the hydraulic fluid to the control valve further downstream even when the flow of the hydraulic fluid through the center bypass oil passage C1L is restricted or blocked by any of the control valves 171, 173, and 175L.

The parallel oil passage C2R supplies the hydraulic fluid of the main pump 14R to the control valves 172, 174, 175R, and 176R in parallel with the center bypass oil passage C1R. Specifically, the parallel oil passage C2R branches from the center bypass oil passage C1R on the upstream of the control valve 172, and is configured to be able to supply the hydraulic fluid of the main pump 14R to each of the control valves 172, 174, 175R, and 176R in parallel. Accordingly, the parallel oil passage C2R can supply the hydraulic fluid to the control valve further downstream even when the flow of the hydraulic fluid through the center bypass oil passage C1R is restricted or blocked by any of the control valves 172, 174, and 175R.

The regulators 13L and 13R adjust the discharge amount of the main pumps 14L and 14R by adjusting the tilting angle of the swash plates of the main pumps 14L and 14R, respectively, under the control of the shovel controller 30.

The discharge pressure sensor 28L detects the discharge pressure of the main pump 14L, and the detection signal corresponding to the detected discharge pressure is acquired by the shovel controller 30. The same applies to the discharge pressure sensor 28R. Accordingly, the shovel controller 30 can control the regulators 13L and 13R according to the discharge pressures of the main pumps 14L and 14R.

In the center bypass oil passages C1L and C1R, negative control throttles 18L and 18R are provided between each of the most downstream control valves 176L and 176R and the hydraulic fluid tank. Accordingly, the flow of the hydraulic fluid discharged by the main pumps 14L and 14R is restricted by the negative control throttles 18L and 18R. The negative control throttles 18L and 18R generate a control pressure for controlling the regulators 13L and 13R.

The negative control pressure sensors 19L and 19R detect the negative control pressure, and the detection signal corresponding to the detected negative control pressure is acquired by the shovel controller 30.

The shovel controller 30 may control the regulators 13L and 13R and adjust the discharge amount of the main pumps 14L and 14R depending on the discharge pressure of the main pumps 14L and 14R detected by the discharge pressure sensors 28L and 28R. For example, the shovel controller 30 may reduce the discharge amount by controlling the regulator 13L and adjusting the tilting angle of the swash plate of the main pump 14L when the discharge pressure of the main pump 14L increases. The same applies to the regulator 13R. Accordingly, the shovel controller 30 can control the total horsepower of the main pumps 14L and 14R so that the absorbed horsepower of the main pumps 14L and 14R, which is expressed as the product of the discharge pressure and the discharge amount, does not exceed the output horsepower of the engine 11.

The shovel controller 30 may adjust the discharge amount of the main pumps 14L and 14R by controlling the regulators 13L and 13R depending on the negative control pressure detected by the negative control pressure sensors 19L and 19R. For example, the shovel controller 30 decreases the discharge amount of the main pumps 14L and 14R when the negative control pressure is high, and increases the discharge amount of the main pumps 14L and 14R when the negative control pressure is low.

Specifically, when the shovel 100 is in a standby state (the state illustrated in FIG. 5) where none of the hydraulic actuators are operated, the hydraulic fluid discharged from the main pumps 14L and 14R passes through the center bypass oil passages C1L and C1R and reaches the negative control throttles 18L and 18R. The flow of the hydraulic fluid discharged from the main pumps 14L and 14R increases the negative control pressure generated upstream of the negative control throttles 18L and 18R. As a result, the shovel controller 30 reduces the discharge amount of the main pumps 14L and 14R to the minimum allowable discharge amount, and suppresses pressure loss (pumping loss) when the discharged hydraulic fluid passes through the center bypass oil passages C1L and C1R.

When any of the hydraulic actuators is operated through the operation device 26, the hydraulic fluid discharged from the main pumps 14L and 14R flows into the hydraulic actuator to be operated through the control valve corresponding to the hydraulic actuator to be operated. The flow of the hydraulic fluid discharged from the main pumps 14L and 14R reduces or eliminates the amount reaching the negative control throttles 18L and 18R, thereby reducing the negative control pressure generated upstream of the negative control throttles 18L and 18R. As a result, the shovel controller 30 can increase the discharge amount of the main pumps 14L and 14R, circulate sufficient hydraulic fluid to the hydraulic actuator to be operated, and reliably drive the hydraulic actuator to be operated.

The operation device 26 includes a left operation lever 26L, a right operation lever 26R, and a traveling lever 26D. The traveling lever 26D includes a left traveling lever 26DL and a right traveling lever 26DR.

The left operation lever 26L and the right operation lever 26R receive operations in one or more of the front-rear direction and the left-right direction.

The left operation lever 26L is used for turning operations and operating the arm 5. When the left operation lever 26L is operated in the front-rear direction, the control pressure corresponding to the lever operation amount is introduced into the pilot ports of the control valves 176L and 176R by using the hydraulic fluid discharged by the pilot pump 15. When the left operation lever 26L is operated in the left-right direction, the control pressure corresponding to the lever operation amount is introduced into the pilot port of the control valve 173 by using the hydraulic fluid discharged by the pilot pump 15.

Specifically, when the left operation lever 26L is operated in the arm closing direction, the shovel controller 30 causes the hydraulic fluid to be introduced into the right pilot port of the control valve 176L and the hydraulic fluid to be introduced into the left pilot port of the control valve 176R. When the left operation lever 26L is operated in the arm opening direction, the shovel controller 30 causes the hydraulic fluid to be introduced into the left pilot port of the control valves 176L and the hydraulic fluid to be introduced into the right pilot port of the control valve 176R. When the left operation lever 26L is operated in the left turning direction, the shovel controller 30 causes the hydraulic fluid to be introduced into the left pilot port of the control valve 173, and when it is operated in the right turning direction, the shovel controller 30 causes the hydraulic fluid to be introduced into the right pilot port of the control valve 173. In order for the shovel controller 30 to perform the control, outputs from operation sensors 29LA and 29LB are used.

The right operation lever 26R is used for operating the boom 4 and operating the bucket 6. When the right operation lever 26R is operated in the front-rear direction, the control pressure corresponding to the lever operation amount is introduced into the pilot port of the control valve 175 by using the hydraulic fluid discharged from the pilot pump 15. When it is operated in the left-right direction, the control pressure corresponding to the lever operation amount is introduced into the pilot port of the control valve 174 by using the hydraulic fluid discharged by the pilot pump 15.

Specifically, when the right operation lever 26R is operated in the boom lowering direction, the shovel controller 30 causes the hydraulic fluid to be introduced into the left pilot port of the control valve 175R. When the right operation lever 26R is operated in the boom raising direction, the shovel controller 30 causes the hydraulic fluid to be introduced into the right pilot port of the control valve 175L and the hydraulic fluid to be introduced into the left pilot port of the control valve 175R. When the right operation lever 26R is operated in the bucket closing direction, the shovel controller 30 causes the hydraulic fluid to be introduced into the right pilot port of the control valve 174, and when it is operated in the bucket opening direction, the shovel controller 30 causes the hydraulic fluid to be introduced into the left pilot port of the control valve 174. In order for the shovel controller 30 to perform the control, outputs from operation sensors 29RA and 29RB are used.

The left traveling lever 26DL is used for operating a left crawler 1CL and may be configured to work in conjunction with a left traveling pedal. When the left traveling lever 26DL is operated in the front-rear direction, the shovel controller 30 causes the control pressure corresponding to the lever operation amount to be introduced into the pilot port of the control valve 171 by using the hydraulic fluid discharged from the pilot pump 15. The right traveling lever 26DR is used for operating a right crawler 1CR and may be configured to work in conjunction with a right traveling pedal. When the right traveling lever 26DR is operated in the front-rear direction, the shovel controller 30 causes the control pressure corresponding to the lever operation amount to be introduced into the pilot port of the control valve 172 by using the hydraulic fluid discharged from the pilot pump 15. In order for the shovel controller 30 to perform the control, outputs from operation sensors 29DL and 29DR described later are used.

The operation sensor 29 is configured to detect the details of operations performed by the operator using the operation device 26. In the present embodiment, the operation sensor 29 detects the operation direction and the operation amount of the operation device 26 corresponding to each of the actuators, and outputs the detected value to the shovel controller 30.

The operation sensor 29 includes the operation sensors 29LA, 29LB, 29RA, 29RB, 29DL, and 29DR. The operation sensor 29LA detects the details of operations in the front-rear direction with respect to the left operation lever 26L performed by the operator, and outputs the detected value to the shovel controller 30. The details of operations are, for example, a lever operation direction, a lever operation amount (a lever operation angle), and the like.

Similarly, the operation sensor 29LB detects the details of operations in the left-right direction with respect to the left operation lever 26L performed by the operator, and outputs the detected value to the shovel controller 30. The operation sensor 29RA detects the details of operations in the front-rear direction with respect to the right operation lever 26R performed by the operator, and outputs the detected value to the shovel controller 30. The operation sensor 29RB detects the details of operations in the left-right direction with respect to the right operation lever 26R performed by the operator, and outputs the detected value to the shovel controller 30.

The operation sensor 29DL detects the details of operations in the front-rear direction with respect to the left traveling lever 26DL performed by the operator, and outputs the detected value to the shovel controller 30. The operation sensor 29DR detects the details of operations in the front-rear direction with respect to the right traveling lever 26DR performed by the operator, and outputs the detected value to the shovel controller 30.

The shovel controller 30 receives the output of the operation sensor 29, outputs a control command to the regulator 13 as necessary, and changes the discharge amount of the main pump 14. The shovel controller 30 receives the output of the control pressure sensor 19 provided upstream of the throttle 18 and, when necessary, outputs a control command to the regulator 13 to change the discharge amount of the main pump 14. The throttle 18 includes a left throttle 18L and a right throttle 18R, and the control pressure sensor 19 includes negative control pressure sensors 19L and 19R.

<Block Configuration of Remote Operation System>

Figure 6:
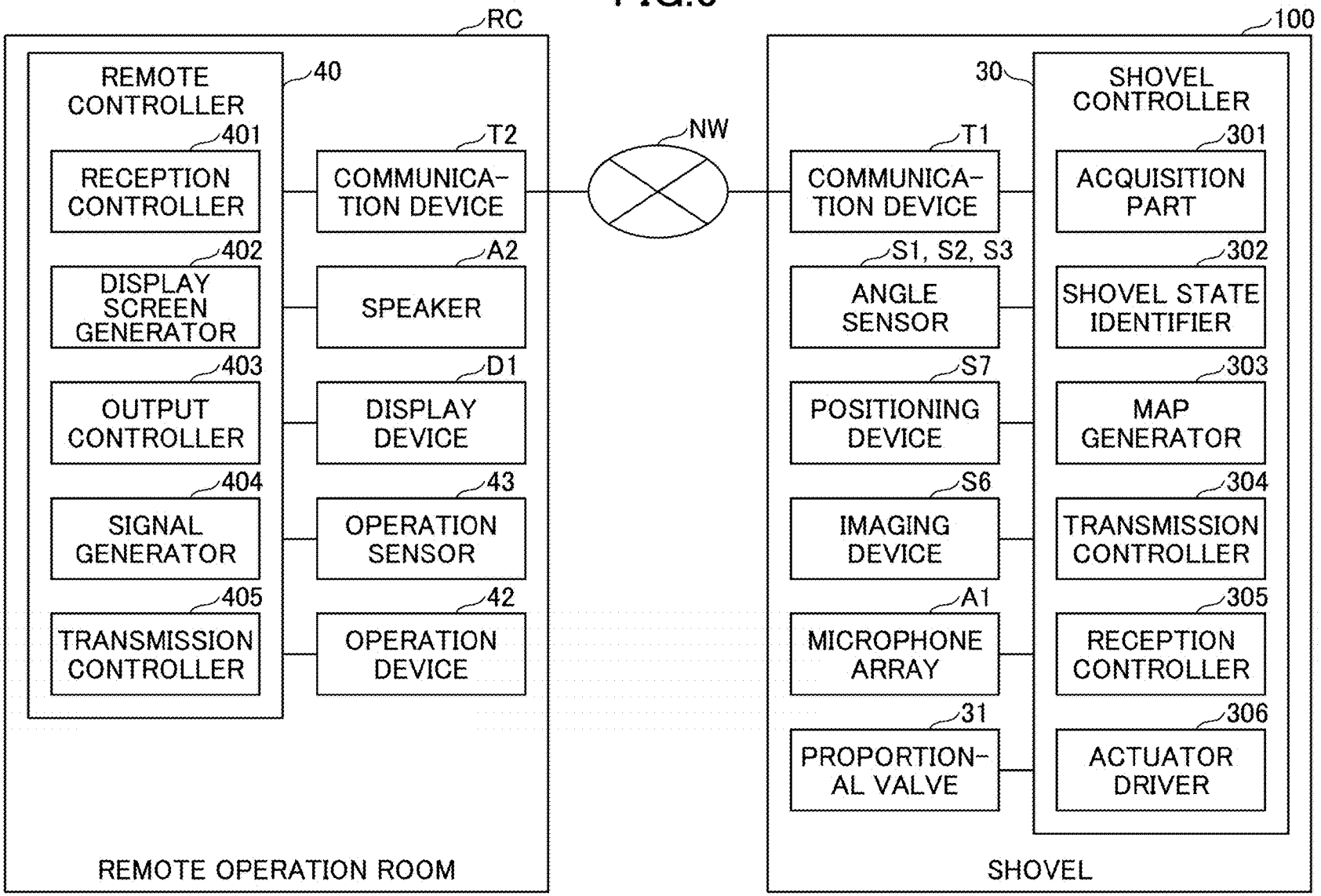
FIG. 6 is a functional block diagram illustrating a configuration example of a remote operation system according to the one embodiment.

FIG. 6 is a functional block diagram illustrating a configuration example of a remote operation system SYS according to the present embodiment. In the example illustrated in FIG. 6, block configurations of the remote operation room RC and the shovel 100 included in the remote operation system SYS are illustrated. The hardware configuration of the shovel 100 is as described above, and the explanation thereof is omitted.

<Configuration of Remote Operation Room RC>

The remote operation room RC includes the remote controller 40, the communication device T2, the speaker A2, the operation sensor 43, and the display device D1. The speaker A2, the communication device T2, and the operation sensor 43 have been described above, and the explanations thereof are omitted.

Figure 7:
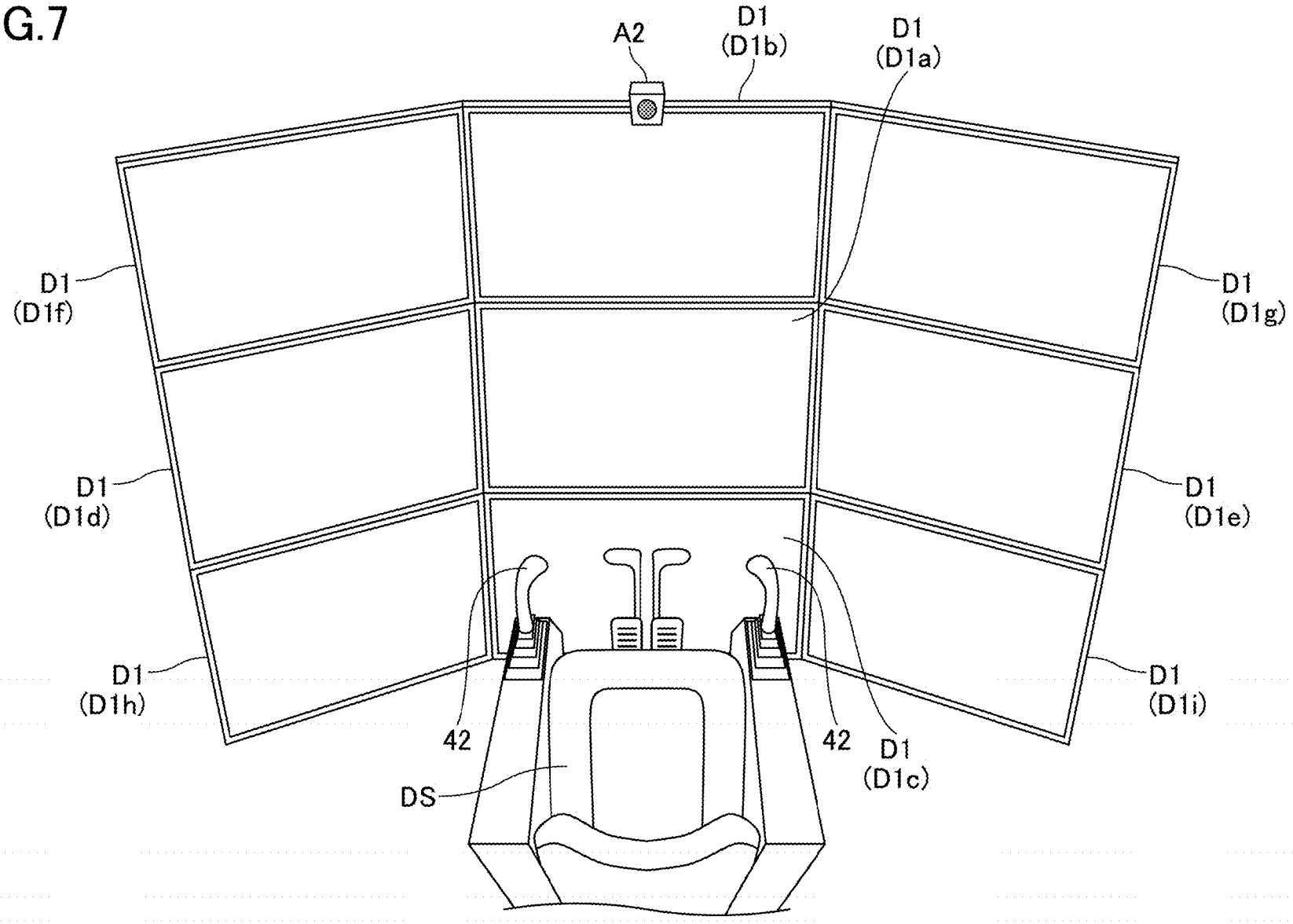
FIG. 7 is a diagram illustrating an arrangement example of a remote operation room RC according to the one embodiment.

Next, the remote operation room RC will be described. FIG. 7 is a diagram illustrating an arrangement example of the remote operation room RC. In the remote operation room RC, a plurality of operation devices 42 are provided around the operation seat DS.

In the present embodiment, as illustrated in FIG. 7, the display device D1 is a multi-display consisting of nine monitors in three vertical rows and three horizontal columns. Specifically, the display device D1 includes a central monitor D1*a*, an upper monitor D1*b*, a lower monitor D1*c*, a left monitor D1*d*, a right monitor D1*e*, an upper left monitor D1*f*, an upper right monitor D1*g*, a lower left monitor D1*h*, and a lower right monitor D1*i*.

In the present embodiment, the speaker A2 is provided at the top of the display device D1. The speaker A2 is provided, for example, for outputting sound collected by the microphone array A1 of the shovel 100.

<<Function Block of Shovel>>

Referring back to FIG. 6, each functional block in the shovel controller 30 of the shovel 100 will be described. Each functional block in the shovel controller 30 is conceptual and does not necessarily need to be physically configured as illustrated. All or part of each functional block can be functionally or physically distributed and integrated in arbitrary units. All or any part of each processing function performed in each functional block is achieved by a program executed by a CPU. Alternatively, each functional block may be achieved as hardware using wired logic. The shovel controller 30 includes an acquisition part 301, a shovel state identifier 302, a map generator 303, a transmission controller 304, a reception controller 305, and an actuator driver 306, by executing a program.

Figure 8:
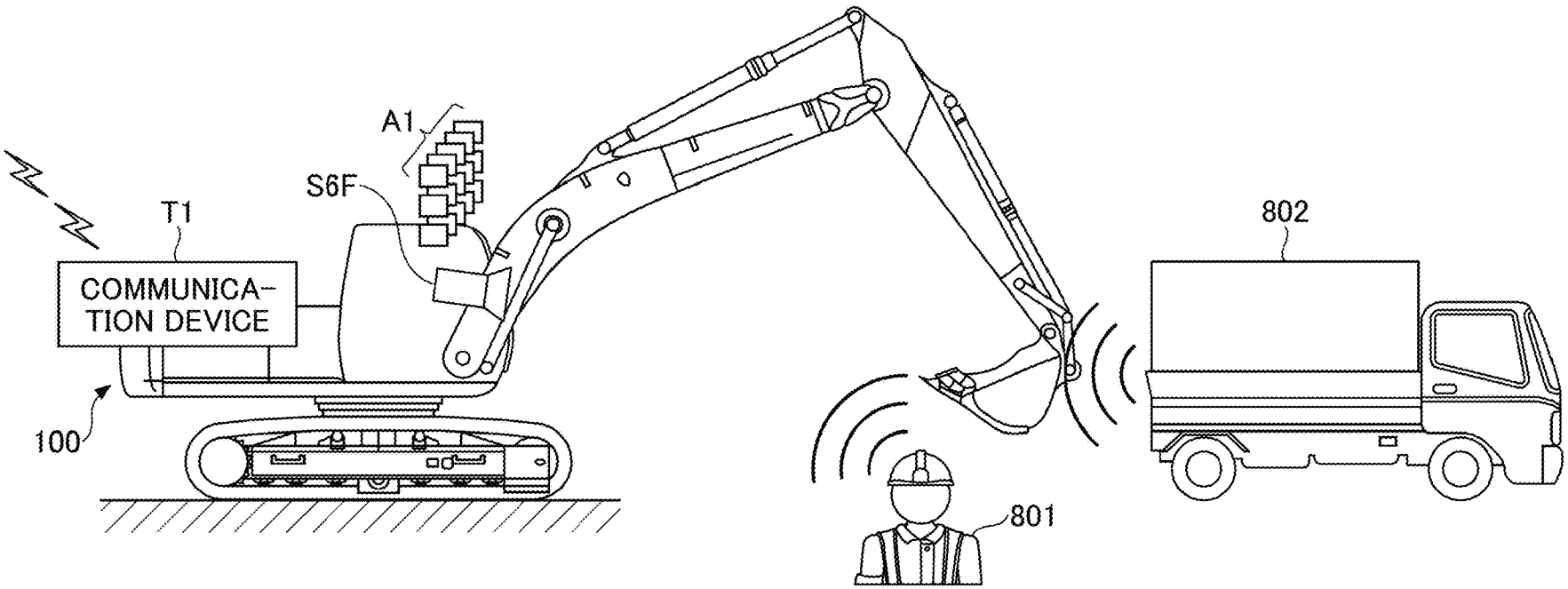
FIG. 8 is a conceptual diagram illustrating a situation around the shovel according to the one embodiment.

FIG. 8 is a conceptual diagram illustrating a situation around the shovel 100 according to the present embodiment. The example illustrated in FIG. 8 is an example in which the shovel 100, a worker 801, and a truck 802 are included.

The worker 801 is speaking to the shovel 100. Because the truck 802 is in operation, the engine noise thereof reaches the shovel 100.

The imaging area of the front camera S6F of the shovel 100 includes the worker 801 and the truck 802.

Further, the microphone array A1 collects the utterance of the worker 801 and the engine noise of the truck 802.

The shovel controller 30 transmits a sound signal indicating the sound collected by the microphone array A1 of the shovel 100 to the communication device T2 of the remote operation room RC via the communication device T1.

Further, the shovel 100 generates information (corresponding to a sound heat map described later) indicating the sound generation situation around the shovel 100 based on the sound signal acquired by the microphone array A1, and transmits the generated information from the communication device T1 to the communication device T2 of the remote operation room RC. A specific configuration of the shovel 100 for achieving the transmission of the information will be described below.

Referring back to FIG. 6, the acquisition part 301 acquires signals from various detection devices provided in the shovel 100. For example, the acquisition part 301 acquires the detection results of the boom angle sensor S1, the arm angle sensor S2, and the bucket angle sensor S3. The acquisition part 301 also acquires the measurement results of the position, orientation, and the like of the shovel 100 from the positioning device S7. The acquisition part 301 also acquires the image information from the imaging device S6. The acquisition part 301 also acquires the sound signal collected by each of the microphones constituting the microphone array A1 from the microphone array A1.

The shovel state identifier 302 identifies the state of the shovel 100 based on the signal acquired by the acquisition part 301. In the present embodiment, the state of the shovel 100 includes the position and orientation of the shovel 100 and the state of the attachment (for example, positions of the boom 4, the arm 5, and the bucket 6) of the shovel 100. The position of the shovel 100 is, for example, the position in the reference coordinate system of the shovel 100 (the latitude, longitude, and altitude of the reference point of the shovel 100). The shovel state identifier 302 specifies the position and orientation of the shovel 100 based on the output of the positioning device S7.

The state of the attachment (for example, positions of the boom 4, the arm 5, and the bucket 6) can be identified from the detection result of the angle sensor (the boom angle sensor S1, the arm angle sensor S2, and the bucket angle sensor S3) and the size of each of the boom 4, the arm 5, and the bucket 6.

The map generator 303 generates a sound heat map indicating the intensity of the sound around the shovel 100 based on the sound signal collected by each of the microphones constituting the microphone array A1.

The sound heat map according to the present embodiment is a two-dimensional map in the height direction (Z-axis direction) of the shovel 100 and the width direction (Y-axis direction) of the shovel 100, and is a map indicating the intensity of the collected sound in each sound collection direction in the sound collection range of the microphone array A1. The intensity of the sound indicates the magnitude of the amplitude in the sound signal.

Figure 9:
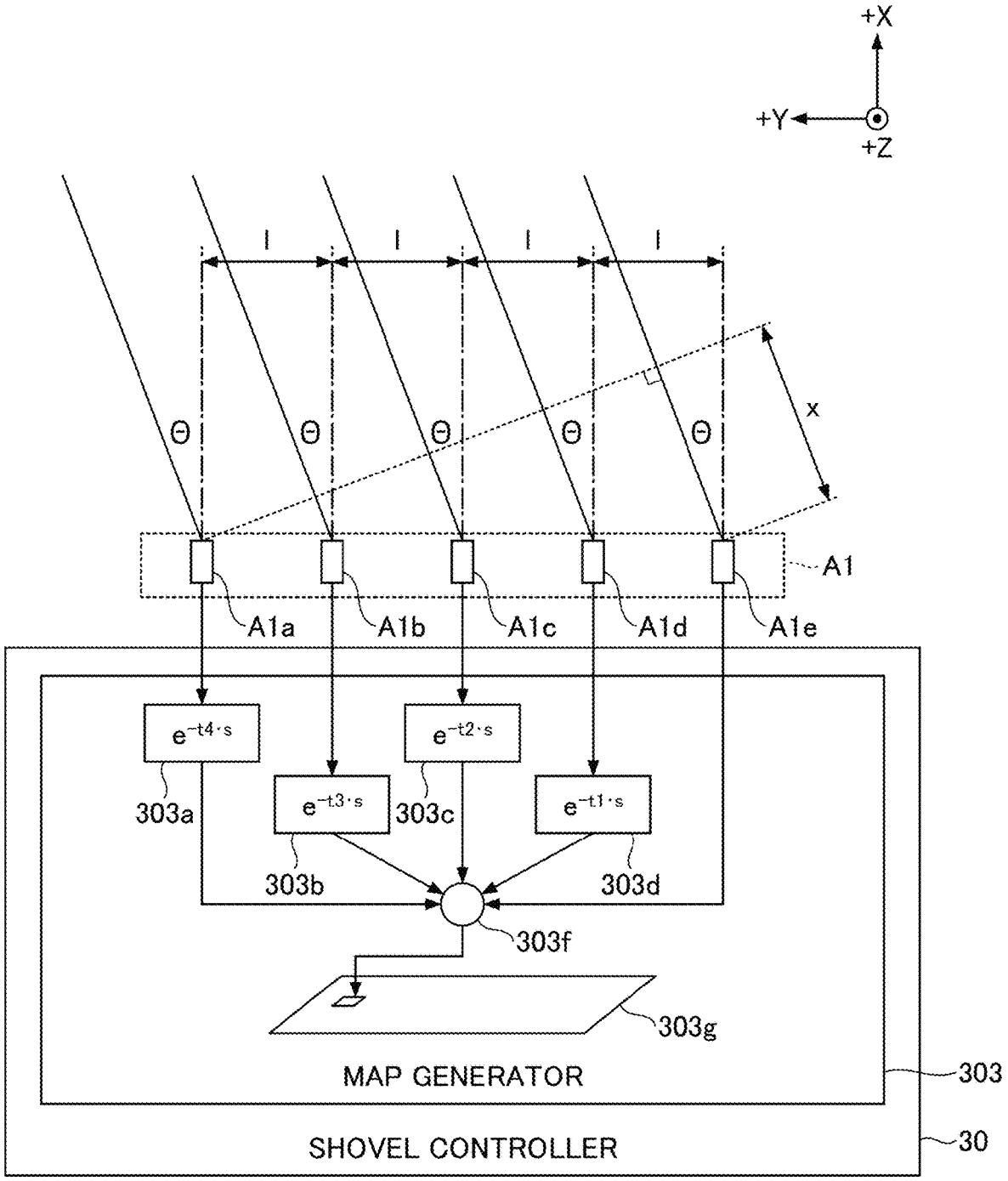
FIG. 9 is a conceptual diagram illustrating generation of a sound heat map by a sound signal of the microphone array in a map generator according to the one embodiment.

FIG. 9 is a conceptual diagram illustrating generation of the sound heat map by the sound signal of the microphone array A1 in the map generator 303 according to the present embodiment. In the example illustrated in FIG. 9, for ease of explanation, an example is described in which the microphone array A1 is composed of microphones A1*a* to A1*e*.

As illustrated in FIG. 9, the microphones A1*a* to A1*e* of the microphone array A1 output sound signals collected in each sound collection direction in the sound collection range, to the shovel controller 30. Then, the sound signals acquired by the acquisition part 301 of the shovel controller 30 are output to the map generator 303. The map generator 303 sets a delay unit(s) corresponding to the sound collection direction for the sound signals collected by each of the microphones A1*a* to A1*e*.

In the example illustrated in FIG. 9, in order to recognize the intensity of the sound signal collected from a direction tilted from the front by an angle θ in the width direction (Y-axis direction), the map generator 303 assigns a delay unit 303*a* corresponding to the microphone A1*a*, a delay unit 303*b* corresponding to the microphone A1*b*, a delay unit 303*c* corresponding to the microphone A1*c*, and a delay unit 303*d* corresponding to the microphone A1*d*. The delay units 303*a* to 303*d* are determined according to the angle θ indicating the sound collection direction.

For example, the delay unit 303*a* generates a sound signal considering the delay of time t4 by calculation on the sound signal input from the microphone A1*a* using "$e^{-t4\cdot s}$". s is the Laplace operator. The time t4 indicates the delay time from the time when the microphone A1*a* collects sound to the time when the microphone A1*e* collects sound when the sound collection direction is tilted by the angle θ in the width direction. Specifically, the time t4 can be calculated from the equation "t4=4·l·sin θ/v". The distance l is the distance between the microphones. The speed of sound is defined as v. The specific calculations by the delay units 303*a* to 303*d* may be performed using publicly-known method, and the explanation thereof is omitted. The speed of sound v may be a fixed value or may be calculated based on the detected air temperature or the like. In the present embodiment, an example of the delay units 303*a* to 303*d* is illustrated, and any publicly-known circuit may be used as long as the delay of the sound signal is considered.

The delay unit 303*b* generates a sound signal considering the delay of time t3 by calculation on the sound signal input from the microphone A1*b* using "$e^{-t3\cdot s}$". The time t3 indicates the delay time from the time when the microphone A1*b* collects sound to the time when the microphone A1*e* collects sound when the sound collection direction is tilted by the angle θ in the width direction. Specifically, the time t3 can be calculated from the equation "t3=3·l·sin θ/v".

The delay unit 303*c* generates a sound signal considering the delay of time t2 by calculation on the sound signal input from the microphone A1*c* using "$e^{-t2\cdot s}$". The time t2 indicates the delay time from the time when the microphone A1*c* collects sound to the time when the microphone A1*e* collects sound when the sound collection direction is tilted by the angle θ in the width direction. Specifically, the time t2 can be calculated from the equation "t2=2·l·sin θ/v".

The delay unit 303*d* generates a sound signal considering the delay of time t1 by calculation on the sound signal input from the microphone A1*d* using "$e^{-t1\cdot s}$". The time t1 indicates the delay time from the time when the microphone A1*d* collects sound to the time when the microphone A1*e* collects sound when the sound collection direction is tilted by the angle θ in the width direction. Specifically, the time t1 can be calculated from the equation "t1=l·sin θ/v".

Based on the values output from the delay units 303*a* to 303*d* and the sound signal output from the microphone A1*e*, a calculator 303*f* generates a sound signal in which the sound from the direction tilted by the angle θ is emphasized among the sound signals collected by the microphones A1*a* to A1*e*.

The map generator 303 generates a sound heat map 303*g* based on the amplitude of the sound signal generated by the calculator 303*f*. Specifically, in the sound heat map 303*g*, a corresponding region (for example, pixels) is predetermined for each sound collection direction. The map generator 303 assigns a color to the region (for example, pixels) in the sound heat map 303*g*. The color reflects the amplitude of the sound signal in which the sound in the sound collection direction corresponding to the region is emphasized. For example, the map generator 303 assigns colors such that the larger the amplitude, the redder (or darker) the color, and the smaller the parameter, the whiter the color.

The map generator 303 generates, for each sound collection direction in the sound collection range of the microphone array A1, a sound signal in which the sound in the direction is emphasized, and assigns a color corresponding to the amplitude of the sound signal, thereby generates the sound heat map 303*g*.

In the example illustrated in FIG. 9, for ease of explanation, an example in which sound is collected from a direction tilted by the angle θ in the Y-axis direction will be described, but the direction of sound collection is a combination of the Y-axis direction and the Z-axis direction. With regard to the combination of the direction, the intensity of the sound can be recognized by the process described above, and the explanation thereof is omitted.

The transmission controller 304 performs control to transmit various information based on the acquisition result of the acquisition part 301 to the remote operation room RC via the communication device T1. For example, the transmission controller 304 performs control to transmit, to the remote operation room RC, image information captured by the imaging device S6, position information indicating the position and orientation of the shovel 100, state information indicating the status of the attachment, the sound signal collected by the microphone array A1, and the sound heat map. The transmission by the transmission controller 304 is performed every predetermined time. The predetermined time may be any time, but it is set to a time interval that allows the user to recognize changes in the situation due to the work of the shovel 100. For example, the transmission controller 304 may transmit the information at one second intervals.

The reception controller 305 performs control to receive various information from the remote operation room RC via the communication device T1. For example, the reception controller 305 receives an operation signal for controlling the operation of the shovel 100 from the remote operation room RC.

The actuator driver 306 is configured to drive an actuator mounted on the shovel 100. In the present embodiment, the actuator driver 306 generates and outputs an operation signal for each of the plurality of solenoid valves included in the proportional valve 31 based on the operation signal transmitted from the remote operation room RC.

Each of the solenoid valves that receives the operation signal increases or decreases the pilot pressure acting on the pilot port of the corresponding control valve in the control valve unit 17. As a result, the hydraulic actuator corresponding to each control valve operates at a speed corresponding to the stroke amount of the control valve.

<<Function Block of Remote Operation Room>>

Each functional block in the remote controller (an example of a controller) 40 of the remote operation room RC will be described. Each functional block in the remote controller 40 is conceptual and does not necessarily need to be physically configured as illustrated. All or part of each functional block can be functionally or physically distributed and integrated in arbitrary units. All or any part of each processing function performed in each functional block is achieved by a program executed by a CPU. Alternatively, each functional block may be achieved as hardware using wired logic. The remote controller 40 includes a reception controller 401, a display screen generator 402, an output controller 403, a signal generator 404, and a transmission controller 405, by executing a program.

In the present embodiment, a case where the remote controller 40 of the remote operation room RC is a controller of the display device D1 (an example of a display section) will be described. That is, the configuration in the remote operation room RC functions as the display device for supporting remote operation of the shovel 100.

The reception controller 401 performs control to receive various information from the shovel 100 via the communication device T2.

As another example, the reception controller 401 receives (acquires), from the shovel 100, the image information captured by the imaging device S6, the position information, the state information, the sound signal acquired by the microphone array A1, and the sound heat map (an example of information about the sound signal). The image information is information captured by the imaging device S6. The position information is information indicating the position and orientation of the shovel 100 in the reference coordinate system measured by the positioning device S7. The state information is information indicating the state of the attachment (for example, positions of the boom 4, the arm 5, and the bucket 6). The sound heat map is map information indicating the intensity of the sound around the shovel 100 generated by the map generator 303.

The display screen generator 402 generates a display image by superimposing a sound heat map indicating the sound generation situation around the shovel 100 on the image information. Specifically, the display screen generator 402 generates a display image by superimposing the position in the image information and the sound collection direction of the heat map so as to correspond to each other.

The output controller 403 outputs the sound signal of the microphone array A1 from the speaker A2. As a method of outputting sound signals of a plurality of microphones from the speaker A2, any method including publicly-known methods may be used.

The output controller 403 outputs the display image generated by the display screen generator 402 to the display device D1.

The signal generator 404 generates an operation signal for controlling the operation of the shovel 100 depending on the operation received by the operation sensor 43. The transmission controller 405 transmits the generated operation signal to the shovel 100.

Figure 10:
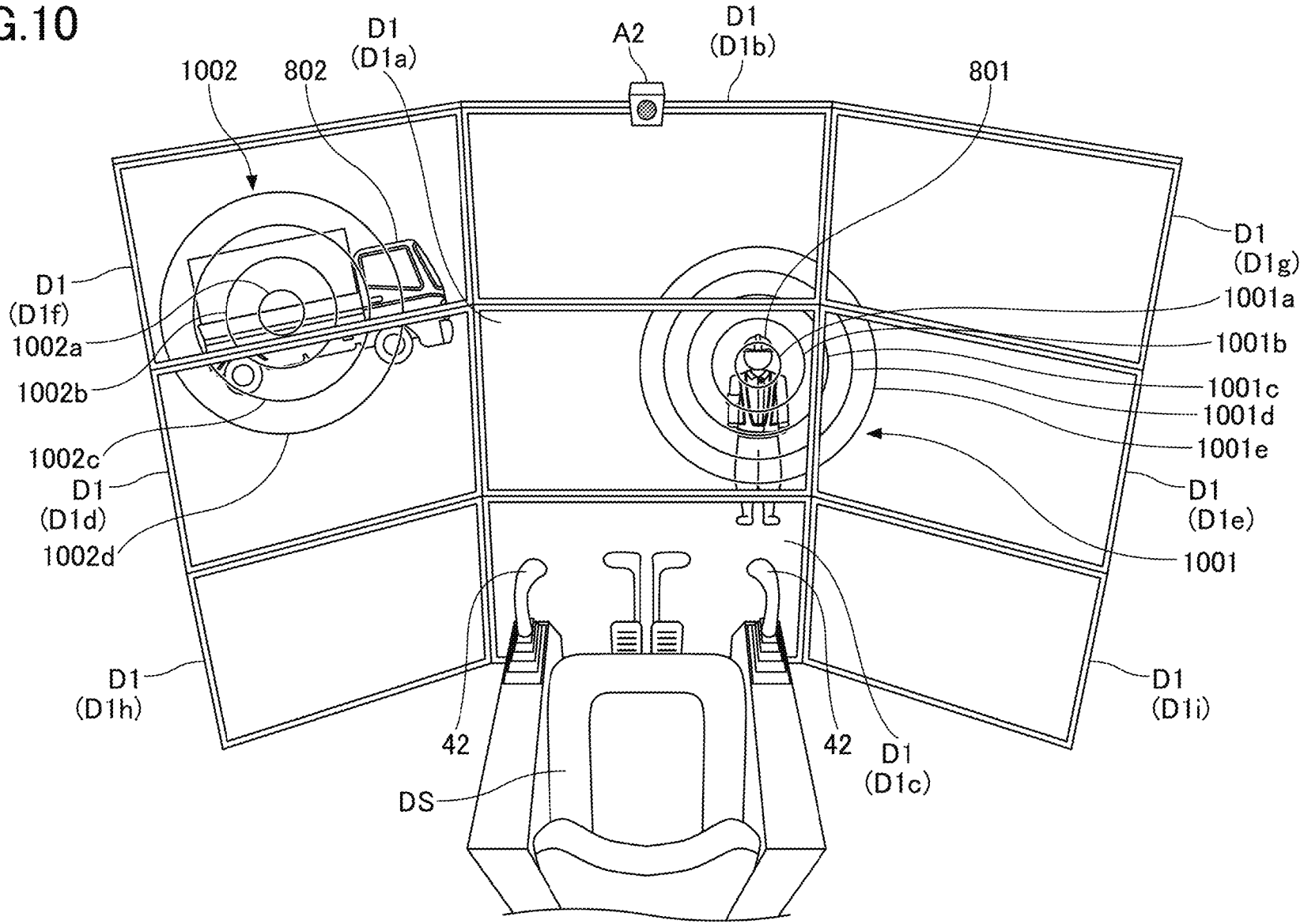
FIG. 10 is a diagram illustrating an example of a display screen displayed on a display device according to the one embodiment.

FIG. 10 is a diagram illustrating an example of a display screen displayed on the display device D1 according to the present embodiment. In the example illustrated in FIG. 10, the worker 801 and the truck 802 in the image information captured by the front camera S6F are displayed. Further, sound detection regions 1001 and 1002 presented as the sound heat map are superimposed on the image information. The sound detection regions 1001 and 1002 are displayed semitransparently (the transmittance may be freely determined).

The sound detection region 1001 is a region displayed based on the sound heat map. The sound detection region 1001 includes a dark red region 1001*a*, a red region 1001*b*, an orange region 1001*c*, a yellow region 1001*d*, and a light yellow region 1001*e*. In the sound detection region 1001, it is illustrated that the sound becomes smaller as it changes from the region 1001*a* to the region 1001*e*. In other words, the region 1001*a* is in the vicinity of the sound source, indicating that the worker 801 is speaking.

Similarly, the sound detection region 1002 includes a red region 1002*a*, an orange region 1002*b*, a yellow region 1002*c*, and a light yellow region 1002*d*. In the sound detection region 1002, similarly, it is illustrated that the sound becomes smaller as it changes from the region 1002*a* to the region 1002*d*. In other words, the region 1002*a* is in the vicinity of the sound source, indicating that the engine of the truck 802 is running.

As illustrated in the screen illustrated in FIG. 10, in the present embodiment, the output controller 403 displays the intensity of the sound acquired from the direction corresponding to each region displayed on the screen in a recognizable display manner, as the sound generation situation around the shovel 100. In the present embodiment, an example is illustrated in which the intensity of the sound is represented by a color, but it is not limited to the example in which the intensity of the sound is represented by a color, and other configurations are also possible. For example, the intensity of the sound may be represented by shading, or by changing the luminance or the like. In the present embodiment, by displaying the display screen so that the intensity of the sound can be recognized, the operator can know the source of the sound. That is, when the operator hears a sound through the speaker A2, the operator can recognize the source of the sound, and therefore can understand the current situation. Then, the operator can perform the operation according to the current situation. Therefore, safety can be improved.

In the sound heat map used to generate the display screen according to the present embodiment, the intensity of the sound acquired in each direction included in the sound collection range of the microphone array A1 is represented by a color. Thus, when the microphone array A1 collects sound from a plurality of sources, the sources of the plurality of sounds are presented as a plurality of sound detection regions in the display image output by the output controller 403. That is, when the sound signal acquired by the microphone array A1 includes a plurality of sound sources, the output controller 403 can display each of the plurality of sound sources in a recognizable display manner. Accordingly, the operator can perform the operation after recognizing the plurality of sound sources. Therefore, safety can be improved.

There may be a difference between the imaging area by the front camera S6F and the sound collection range of the microphone array A1. In this case, the microphone array A1 may acquire a sound signal from a sound source that is not included in the imaging area by the front camera S6F. In this case, the display screen generator 402 may generate a display image by superimposing the sound detection region with the image information, even when the source is not included in the image information.

Figure 11:
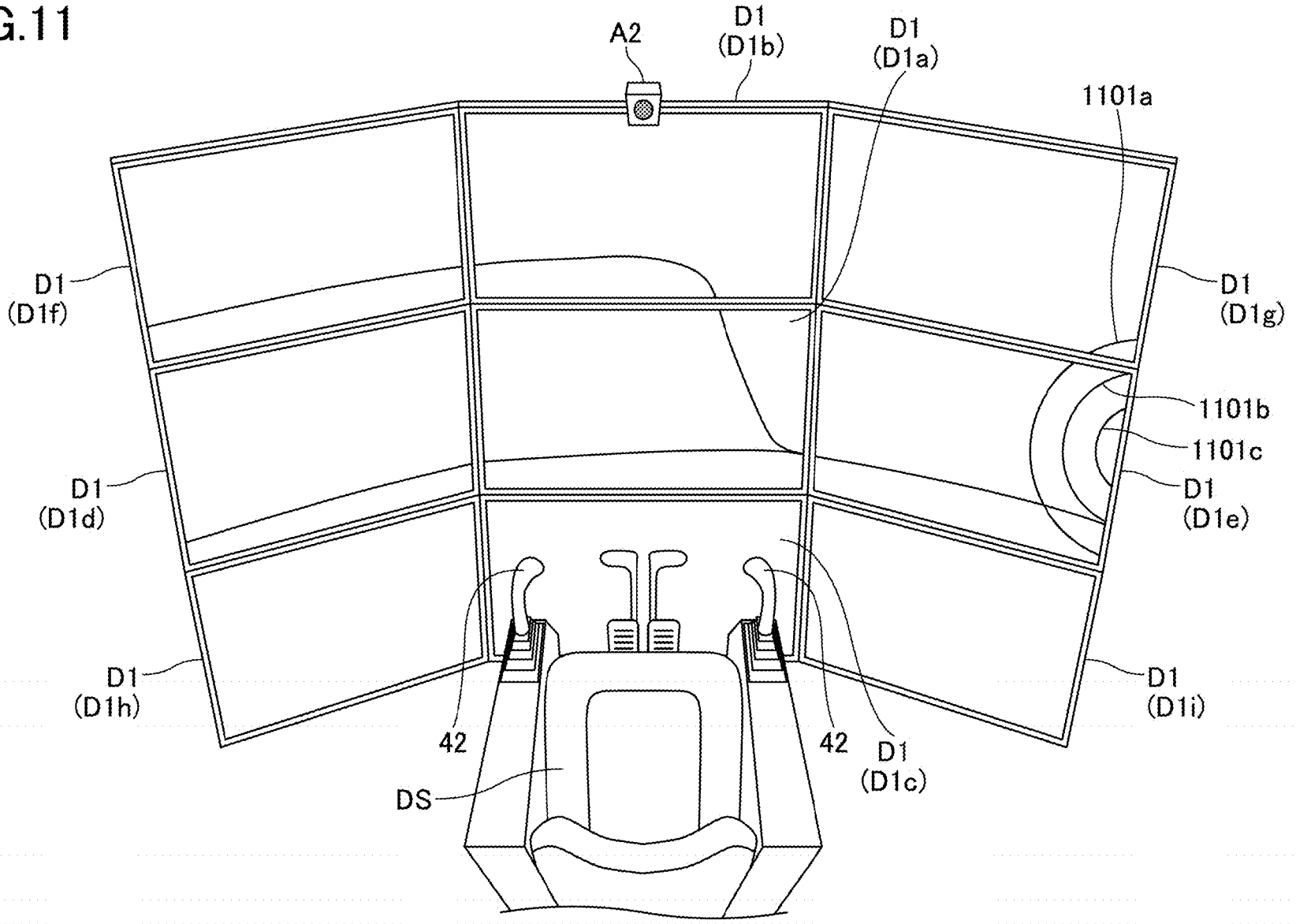
FIG. 11 is a diagram illustrating an example of a display screen displayed on the display device according to the one embodiment.

FIG. 11 is a diagram illustrating an example of a display screen displayed on the display device D1 according to the present embodiment. In the example illustrated in FIG. 11, the source of the sound is not illustrated in the image information captured by the front camera S6F, but the sound detection region 1101 indicating that the source of the sound is on the right side is superimposed on the image information.

The sound detection region 1101 is a region displayed based on the sound heat map. The sound detection region 1101 includes an orange region 1101*a*, a yellow region 1101*b*, and a light yellow region 1101*c*. When sound is output from the speaker A2, the operator can recognize that the source of the sound is on the right side by recognizing the sound detection region 1101.

The sound detection region 1101 illustrated in FIG. 11 is an example of a display manner and it is not limited to the display manner. That is, any display manner may be used as long as it is possible to recognize that the sound signal is acquired from a direction outside the region presented by the image information.

Thus, when the sound signal is acquired from a direction outside the region presented by the image information captured by the front camera S6F, the output controller 403 according to the present embodiment displays that the sound signal is acquired from outside the region presented by the image information on the display device D1. Accordingly, the operator can estimate the direction of the source of the sound even when it is not seen on the display device D1. The operator can perform the work after estimating the direction of the source of the sound. Therefore, safety can be improved.

In the present embodiment, an example in which the shovel controller 30 generates the sound heat map (an example of information about the sound signal) is described. However, it is not limited to the embodiment in which the sound heat map (an example of information about the sound signal) is generated by the shovel controller 30, and the sound heat map may be generated by the remote controller 40, for example.

(Variation 1 of One Embodiment)

In the above-described embodiment, an example is described in which the sound detection region indicating the intensity of the sound is superimposed on the image information. However, it is not limited to the display manner of the above-described embodiment. For example, the content of the utterance may be displayed as textual information.

The display screen generator 402 of the remote controller 40 extracts the voice contained in the sound signal received by the reception controller 401 and converts the voice into textual information. As a voice recognition method for converting the voice into text, a publicly-known method may be used.

The display screen generator 402 generates a display screen by superimposing the converted textual information, together with the sound detection region, on the image information.

Figure 12:
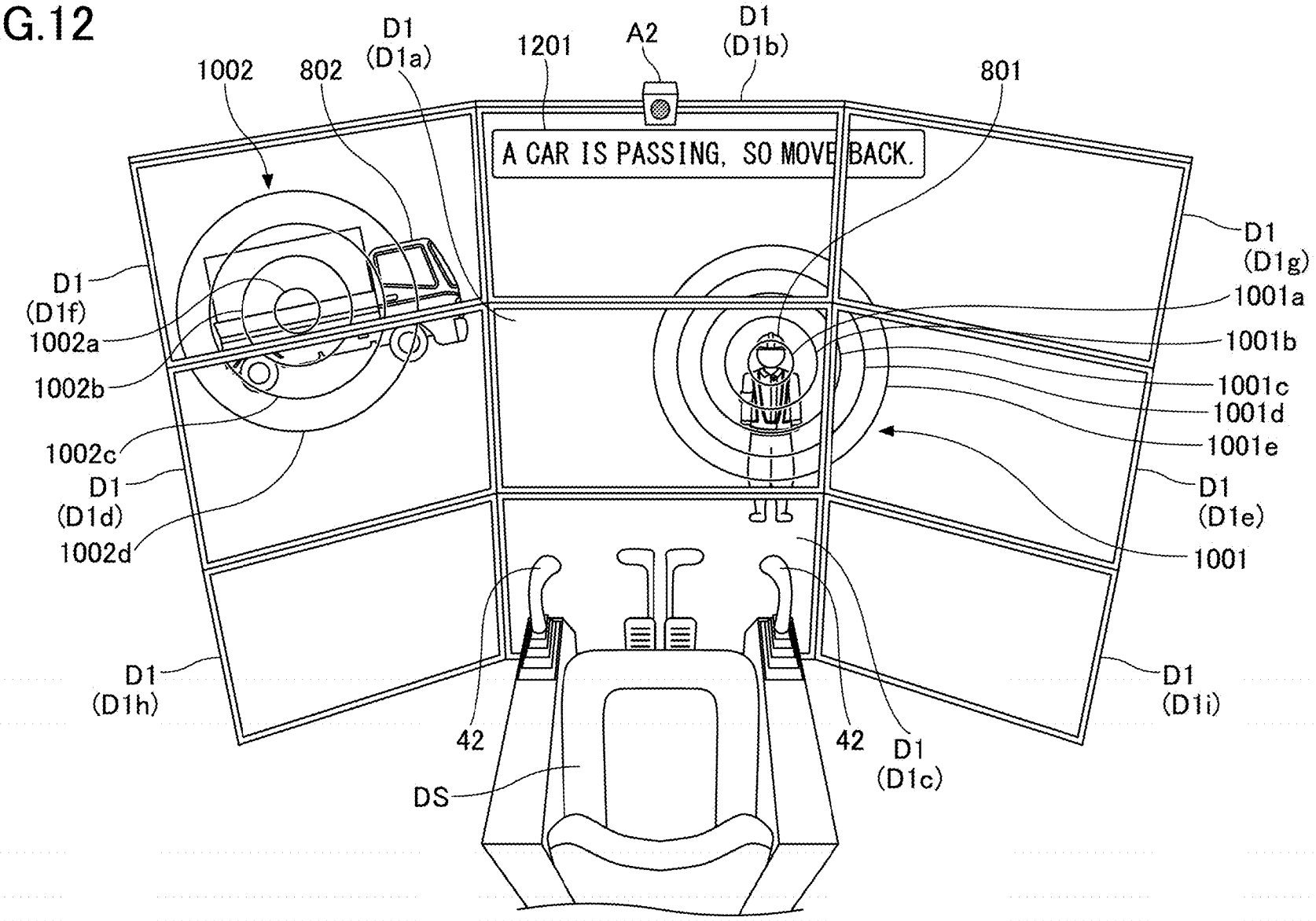
FIG. 12 is a diagram illustrating an example of a display screen displayed on a display device of a remote operation room according to a variation.

The output controller 403 displays the display screen on which the textual information is superimposed. FIG. 12 is a diagram illustrating an example of a display screen displayed on the display device D1 according to the present embodiment. In the example illustrated in FIG. 12, the character string information 1201 is displayed, together with the sound detection regions 1001 and 1002, superimposed on the image information captured by the front camera S6F.

In the present variation, the voice represented by the character string information 1201 is not only output from the speaker A2 but also displayed as the character string information 1201. Thus, the operator can recognize the content of the utterance even when the operator misses or does not hear the voice output from the speaker A2, so that the operator can operate the shovel 100 in consideration of the content of the utterance. Therefore, safety can be improved.

(Variation 2 of One Embodiment)

In the above-described embodiment, an example is described in which sound signals acquired from a specific direction are synthesized based on the delay sum of the sound signals collected by the microphones constituting the microphone array A1, thereby recognizing the intensity of the sound in the specific direction and generating the recognition result as the sound heat map. However, the method for recognizing the sound generation situation is not limited to the method of the above-described embodiment.

For example, the sound signals collected by the microphones constituting the microphone array A1 are a combination of sound signals from different sources. Therefore, the map generator 303 may separate the sound signals acquired by each of the microphones into different sound signals for each source, and specify the source of the sound from the difference in the arrival time of the separated sound signals to the microphones. Then, the transmission controller 304 transmits the information about the sound signal representing the source of the sound and the intensity of the separated sound signal to the remote controller 40. The display screen generator 402 generates a display image by superimposing a sound detection region representing the source of the sound and the intensity of the sound on the image information. Thus, a display screen similar to the above-described embodiment can be displayed. As a method for extracting sound signals for each source, for example, a publicly-known method that combines sound signal duplication and filtering processing may be used.

Another Embodiment

In the above-described embodiment and variations, a method for displaying the sound heat map indicating the sound generation situation around the shovel 100 is described. The case is described in which the sound is collected from the worker 801 and the truck 802 as the sound around the shovel 100 for the purpose of the displaying. However, the object whose sound is collected by the microphone array A1 is not limited to the object around the shovel 100, but also includes an object inside the shovel 100. Therefore, in the another embodiment, the case where the sound from the object inside the shovel 100 is considered will be described.

Figure 13:
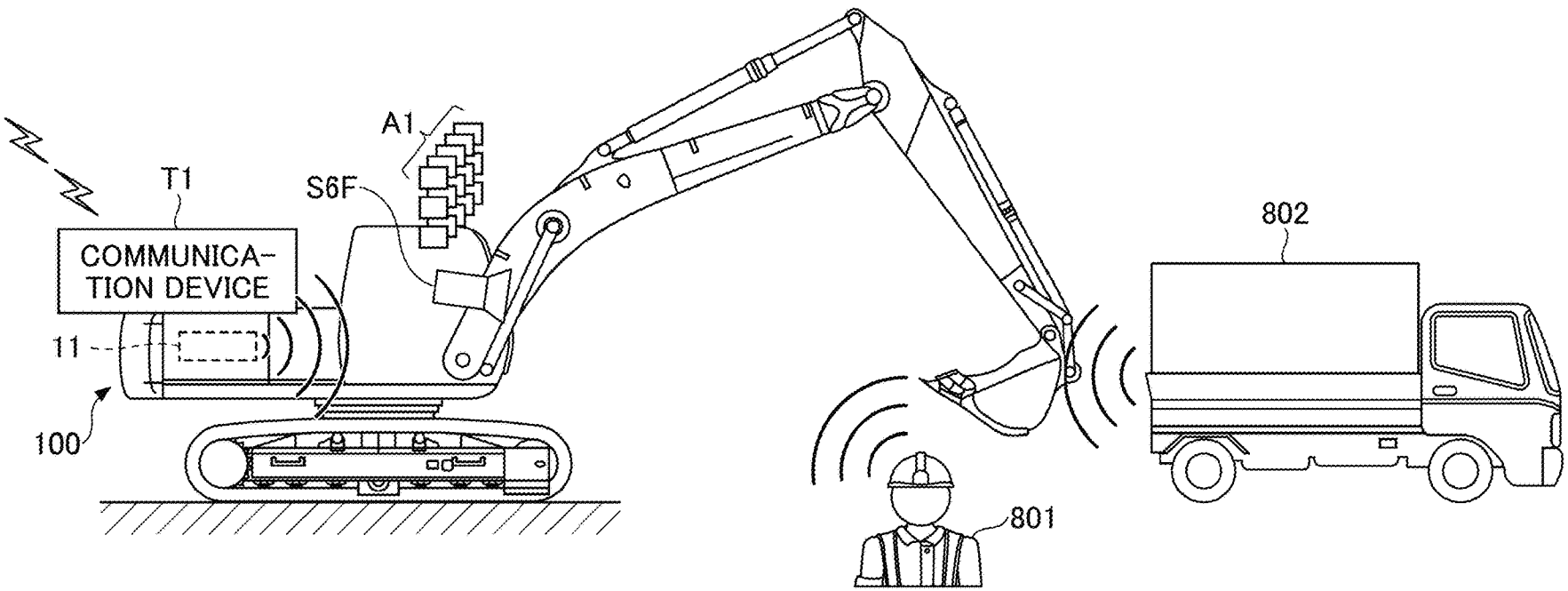
FIG. 13 is a conceptual diagram illustrating a situation around a shovel according to another embodiment.

FIG. 13 is a conceptual diagram illustrating a situation around the shovel 100 according to the present embodiment. In the example illustrated in FIG. 13, the worker 801 and the truck 802 are present around the shovel 100. In the example illustrated in FIG. 13, the engine noise of the engine 11 installed in the shovel 100 is collected by the microphone array A1.

In the remote operation room RC, when the sound output from the speaker A2 includes the engine noise of the engine 11, it may become difficult for the operator to understand the situation around the shovel 100. Therefore, in the present embodiment, the engine noise emitted from the engine 11 of the shovel 100 is controlled to be reduced. In the present embodiment, as a method for reducing the engine noise, an example of filtering the engine noise will be described. In the present embodiment, an example of filtering the engine noise will be described as a method for reducing the engine noise, but other methods may be applied as a method for reducing the engine noise.

Figure 14:
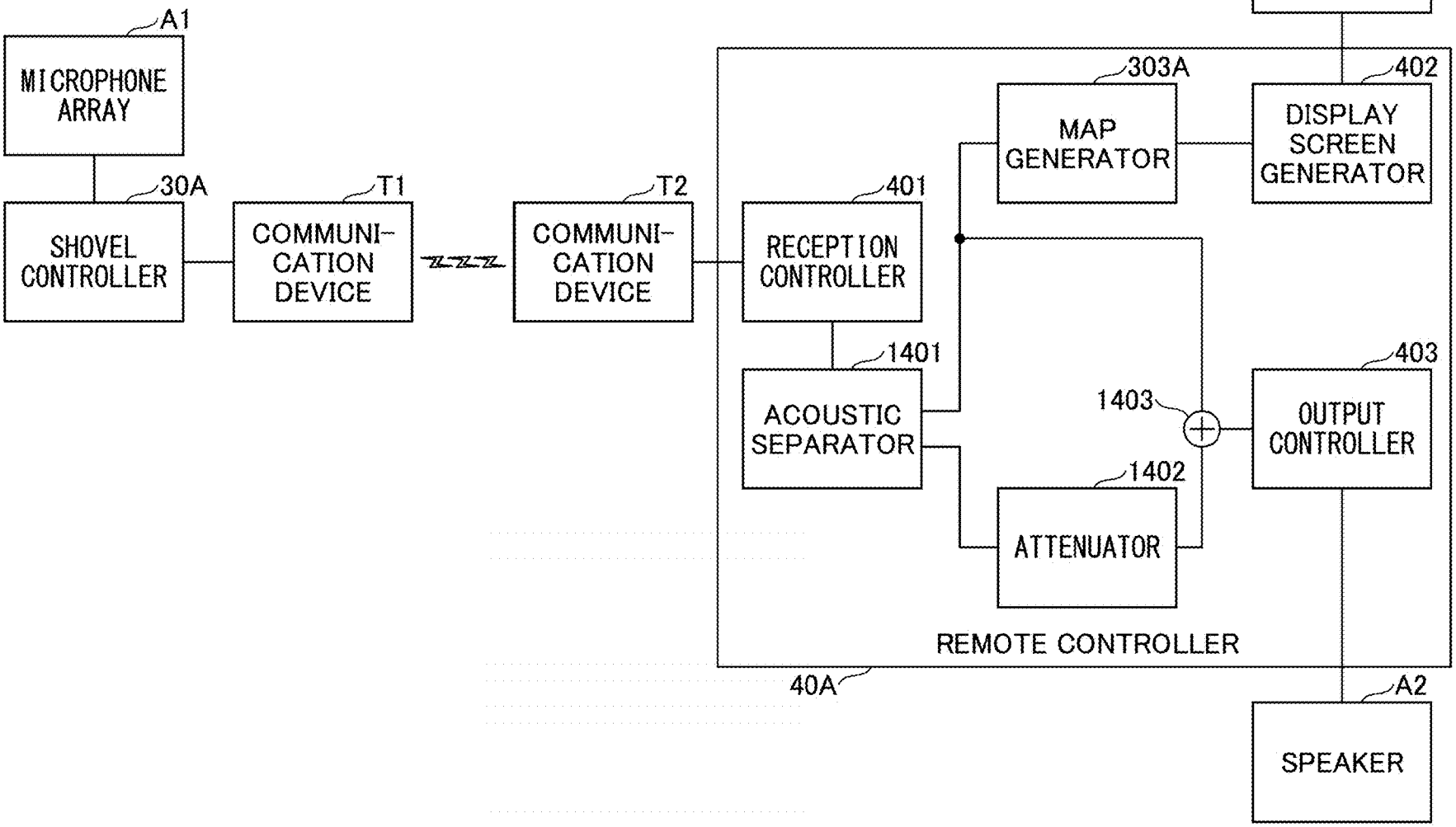
FIG. 14 is a conceptual diagram illustrating a configuration to output sound in a remote operation room in the another embodiment.

FIG. 14 is a conceptual diagram illustrating a configuration to output sound in the remote operation room RC in the present embodiment. In the example illustrated in FIG. 14, an example is described in which the shovel 100 is provided with a shovel controller 30A. Further, the remote operation room RC is provided with a remote controller 40A.

In the example illustrated in FIG. 14, the remote controller 40A includes the reception controller 401, an acoustic separator 1401, an attenuator 1402, an adder 1403, a map generator 303A, the output controller 403, and the display screen generator 402.

In the present embodiment, an example is described in which the remote controller 40A filters the engine noise. That is, in the above-described embodiment, an example is described in which the map generator 303 is provided in the shovel controller 30, but in the present embodiment, the map generator 303A is provided in the remote controller 40A.

In the example illustrated in FIG. 14, the shovel controller 30A transmits a sound signal indicating the sound collected by the microphone array A1 to the communication device T2 of the remote operation room RC via the communication device T1.

The acoustic separator 1401 separates the sound signals that are acquired by each of the microphones and are included in the sound signal received by the reception controller 401 into different sound signals for each source. In the example illustrated in FIG. 14, the sound signals are separated into a sound signal of the engine noise, a sound signal of the worker 801, and a sound signal of the truck 802.

The acoustic separator 1401 according to the present embodiment holds characteristic information (for example, frequency band and waveform) indicating the engine noise of the engine 11. Therefore, the acoustic separator 1401 can identify the sound signal indicating the engine noise from the separated sound signal.

The acoustic separator 1401 outputs the sound signal indicating the engine noise to the attenuator 1402. Meanwhile, the acoustic separator 1401 outputs the sound signal other than the engine noise to the map generator 303A and to the adder 1403.

The map generator 303A generates a sound heat map based on the sound signal obtained by removing the engine noise among the sound signals acquired by each of the microphones constituting the microphone array A1. The generation method is the same as in the variation 2 of the one embodiment, and the explanation thereof will be omitted.

The attenuator 1402 decreases the amplitude of the sound signal indicating the engine noise. That is, in the present embodiment, the attenuator 1402 can attenuate a predetermined frequency component corresponding to the engine noise by decreasing the amplitude of the sound signal indicating the engine noise. The degree of decrease may be determined depending on the implementation.

The adder 1403 adds the sound signal indicating the engine noise that is attenuated by the attenuator 1402, and the other sound signal. Thus, the adder 1403 generates a sound signal in which the engine noise generated from the engine (a driving source) of the shovel 100 (an example of a work machine) is attenuated.

The output controller 403 performs control to output the sound signal after the addition from the speaker A2. At that time, the output controller 403 may synthesize the sound signals from the microphones constituting the microphone array A1 to be output from the speaker A2.

In the present embodiment, the remote controller 40 attenuates the engine noise by performing the control described above, so that the operator can easily understand the situation around the shovel 100 based on the sound output from the speaker A2.

In the present embodiment, because the engine noise is attenuated in the sound output from the speaker A2, the stress on the operator due to the sound can be reduced.

Because a predetermined frequency component such as the engine noise is attenuated from the sound output from the speaker A2 and the sound around the shovel 100 is easier to hear, it becomes easier to understand the surrounding situation by, for example, listening for people speaking around the shovel 100 or any abnormal sounds.

(Variation 1 of Another Embodiment)

In the above-described embodiment, an example is described in which the acoustic separator 1401 performs separation into different sound signals for each source. However, a method for reducing the engine noise is not limited to the method of extracting the sound signal indicating the engine noise and attenuating the sound signal. In the present variation, an example is described in which a band stop filter is provided instead of the acoustic separator 1401, the attenuator 1402, and the adder 1403. In the present variation, the map generator may be provided in the shovel controller or in the remote controller.

In the present variation, the band stop filter attenuates the frequency band corresponding to the engine noise from the sound signals that are acquired by each of the microphones and are included in the sound signal received by the reception controller 401. Then, the output controller 403 outputs the sound signal obtained by attenuating the frequency band corresponding to the engine noise from the speaker A2.

In the present variation, an example is described in which the band stop filter is used as a filter for attenuating the frequency band corresponding to the engine noise, but the filter for attenuating the frequency band corresponding to the engine noise is not limited to the band stop filter, and a notch filter may be used. That is, any filter may be used as long as the frequency band to be attenuated is defined so as to attenuate the frequency band corresponding to the engine noise and not to attenuate other sounds.

In the present variation, by performing the above-described control, the effect similar to that of the another embodiment can be achieved.

In the above-described embodiment and the present variation, an example is described in which the amplitude of the sound signal indicating the engine noise is reduced, as a filtering method. However, the present embodiment is an example of filtering and it is not limited to the filtering method. In other words, any filtering may be used that, when the operator in the remote operation room RC operates the shovel 100, a sound that hinders recognizing of the situation around the shovel 100 is attenuated based on a predetermined condition. Next, another example of filtering based on a predetermined condition will be described.

(Variation 2 of Another Embodiment)

In the above-described embodiment, an example is described in which the engine noise of the engine 11 is attenuated to help the operator recognize the surrounding situation. However, there are other methods to help the operator recognize the surrounding situation. For example, when there are multiple sound sources, it may be difficult to hear human voice. Therefore, in the present variation, a case of facilitating the hearing of human voice will be described.

The frequency band of human voice is approximately 100 Hz to 1, 000 Hz. Therefore, when the frequency band is extracted and output from the speaker A2, the voice can be easily heard.

Therefore, in the present variation, the remote controller 40 of the remote operation room RC can receive the operation of whether or not to filter in the frequency band. As the implementation of the operation device for receiving the operation, any method may be used. For example, a button for switching whether to filter or not may be provided.

When the remote controller 40 receives an operation to filter, it performs filtering to extract the frequency band of 100 Hz to 1,000 Hz from the received sound signal.

The output controller 403 outputs the filtered sound signal from the speaker A2. In the present variation, the frequency band of the voice is extracted, so that the hearing of human voice is facilitated. As a result, the situation around the shovel 100 can be understood, and safety can be improved.

In the present variation, an example is described in which the remote controller 40 of the remote operation room RC receives the operation and switches whether or not to extract the frequency band of 100 Hz to 1,000 Hz corresponding to the human voice. However, in the present variation, the frequency band whose extraction is switched depending on the operation is not limited to the frequency band corresponding to the human voice. For example, whether or not to attenuate the frequency band corresponding to the engine noise, as described in the above embodiment, may be switched according to the operation.

In the present variation, an example is described in which whether or not to filter is switched depending on the operation. However, the condition for switching whether or not to filter is not limited to the presence or absence of the operation. For example, whether or not to filter may be automatically switched depending on whether or not a human voice is detected.

In the above-described embodiment and the present variation, an example is described in which filtering based on a predetermined condition is performed, and either one or more of the generation of the sound heat map and the output from the speaker A2 is performed based on the filtered sound signal. Thus, by presenting the information based on the filtered sound signal to the operator, the operator can recognize the necessary information. Therefore, convenience can be improved.

Further Another Embodiment

In the above-described embodiment, an example is described in which the microphone array A1 is provided on the front surface of the shovel 100. However, it is not limited to the example in which the microphone array A1 is provided on the front surface of the shovel 100 as in the above-described embodiment. Therefore, in the further another embodiment, an example in which the microphone array A1 is provided in each of the four directions will be described.

Figure 15:
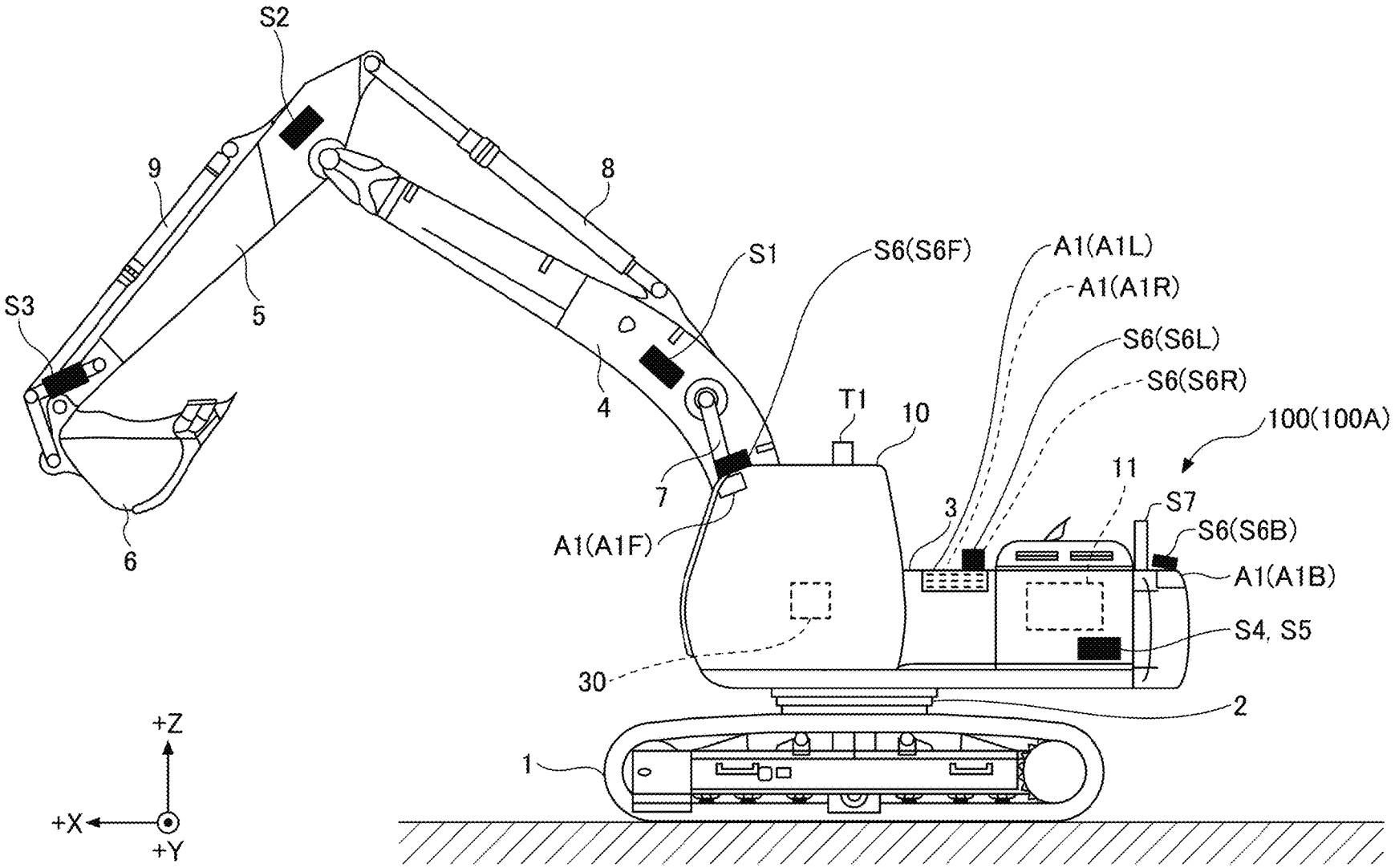
FIG. 15 is a side view of a shovel as a work machine according to further another embodiment.

FIG. 15 is a side view of the shovel 100A as a work machine according to the further another embodiment. The components other than the microphone array A1 are the same as those in the above-described embodiment, and the explanation thereof will be omitted.

The microphone array A1 is configured to acquire sounds around the shovel 100. In the present embodiment, the microphone array A1 includes a front microphone array A1F for collecting sounds in front of the shovel 100, a left microphone array A1L for collecting sounds to the left of the shovel 100, a right microphone array A1R for collecting sounds to the right of the shovel 100, and a rear microphone array A1B for collecting sounds to the rear of the shovel 100.

The imaging device S6 is, for example, a monocular camera having an imaging element such as a CCD or CMOS, and may output the captured image to the display device D1.

The front camera S6F is mounted on the roof of the cabin 10, for example. The left camera S6L is mounted on the left end of the upper surface of the upper turning body 3. The right camera S6R is mounted on the right end of the upper surface of the upper turning body 3. The rear camera S6B is mounted on the rear end of the upper surface of the upper turning body 3.

The left microphone array A1L is mounted, for example, on the left frame of the shovel 100. The right microphone array A1R is mounted, for example, on the right frame of the shovel 100. The rear microphone array A1B is mounted, for example, on the rear frame of the shovel 100.

The map generator 303 of the shovel controller 30 generates sound heat maps corresponding to each of the four microphone arrays A1. The transmission controller 304 transmits the four sound heat maps to the remote controller 40.

Thus, in the remote operation room RC, when the image information of each of the four imaging devices S6 is displayed, the sound detection region can be superimposed. Therefore, when an operation to switch the display from the image information captured by the four imaging devices S6 is received from the operator in the remote operation room RC, the sound detection region can be superimposed on the display image displayed after the switching.

In the present embodiment, the four microphone arrays A1 are provided to correspond to the installation of the imaging devices S6. Therefore, any of the image information captured by the four imaging devices S6 can be displayed with the sound detection region superimposed on the image information. Thus, the operator in the remote operation room RC can understand the source of the sound. Therefore, safety can be improved.

When any one of the image information captured by the four imaging devices S6 is displayed on the display device D1, the display screen generator 402 may generate a display image considering each of the sound heat maps of the microphone array A1 provided in directions not corresponding to the displayed image information. For example, when the display screen generator 402 generates a display image based on the image information of the front camera S6F, in a case where the sound heat map from the left microphone array A1L indicates that the sound is loud, information indicating that the source of the sound is on the left side may be superimposed on the image information of the front camera S6F. In this case, the display screen generator 402 may display the character string information converted from the voice collected from the left microphone array A1L, superimposed on the image information of the front camera S6F. Accordingly, the operator can understand the direction in which the source of the sound exists outside the region displayed on the display screen. Thus, the operator can recognize the direction in which the source of the sound exists. Therefore, safety can be improved.

Even Further Another Embodiment

In the above-described embodiments and variations, a case where the operator performs the operation in the remote operation room RC has been described. However, it is not limited to the case where remote control is performed as in the above-described embodiment, as an implementation of displaying the sound detection region superimposed on the image information. Therefore, in the even further another embodiment, a case where the display is provided to an operator operating on the shovel 100B will be described.

Figure 16:
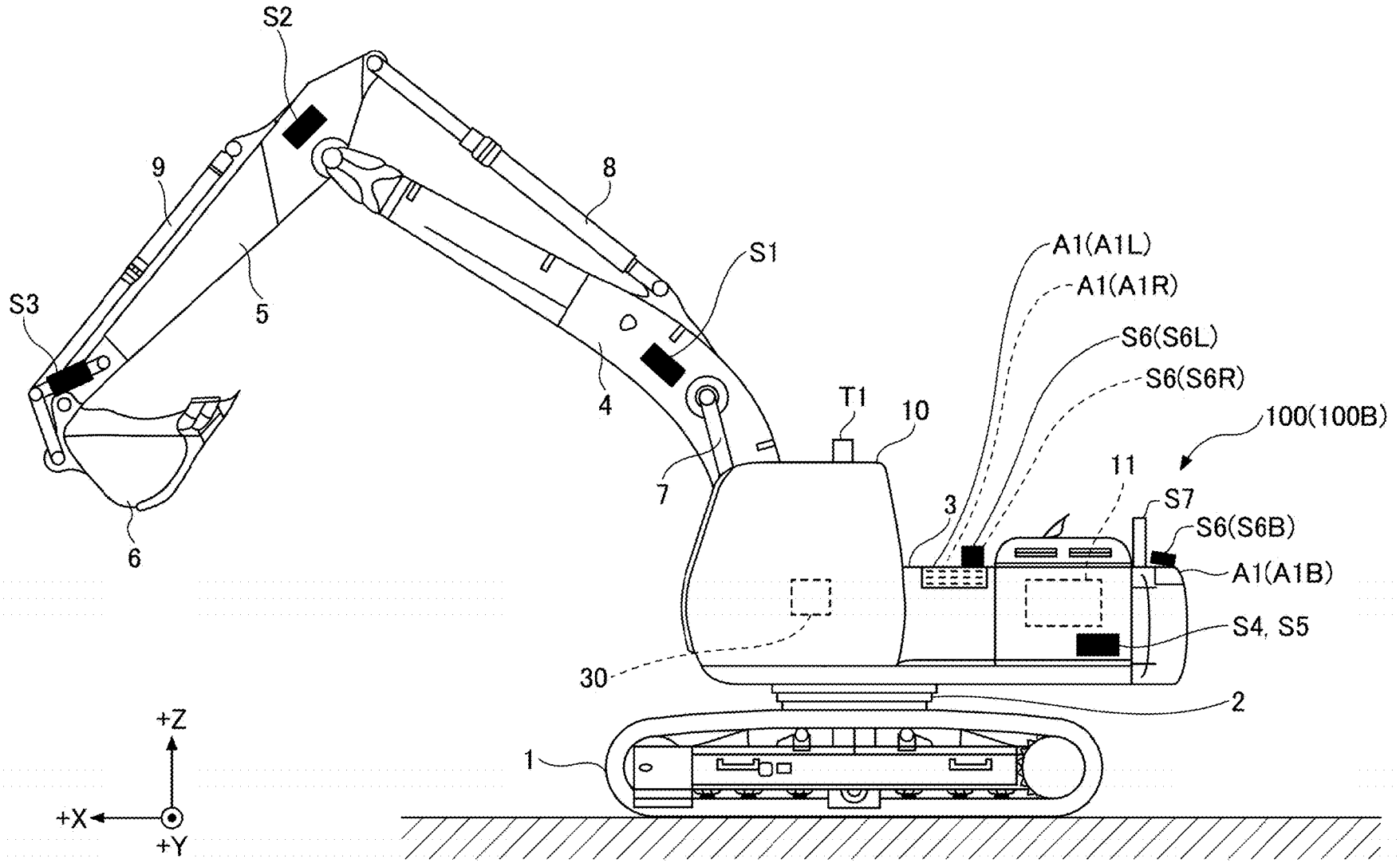
FIG. 16 is a side view of a shovel as a work machine according to even further another embodiment.

FIG. 16 is a side view of the shovel 100B as a work machine according to the even further another embodiment. The components other than the imaging device S6 and the microphone array A1 are the same as those in the above-described embodiment, and the explanation thereof will be omitted.

The imaging device S6 according to the present embodiment includes the left camera S6L for imaging the space to the left of the shovel 100, the right camera S6R for imaging the space to the right of the shovel 100, and the rear camera S6B for imaging the space to the rear of the shovel 100. Thus, in the present embodiment, the front camera S6F is not provided because the operator can visually check the front direction.

Similarly, the microphone array A1 includes the left microphone array A1L for collecting sounds to the left of the shovel 100, the right microphone array A1R for collecting sounds to the right of the shovel 100, and the rear microphone array A1B for collecting sounds to the rear of the shovel 100. The mounting locations are the same as in the above-described embodiment, and a description thereof will be omitted.

The map generator 303 of the shovel controller 30 generates sound heat maps corresponding to each of the three microphone arrays A1. Then, the shovel controller 30 generates a display image by superimposing the sound heat maps indicating the sound generation situation around the shovel 100 on the image information and displays it on a display device DI.

Figure 17:
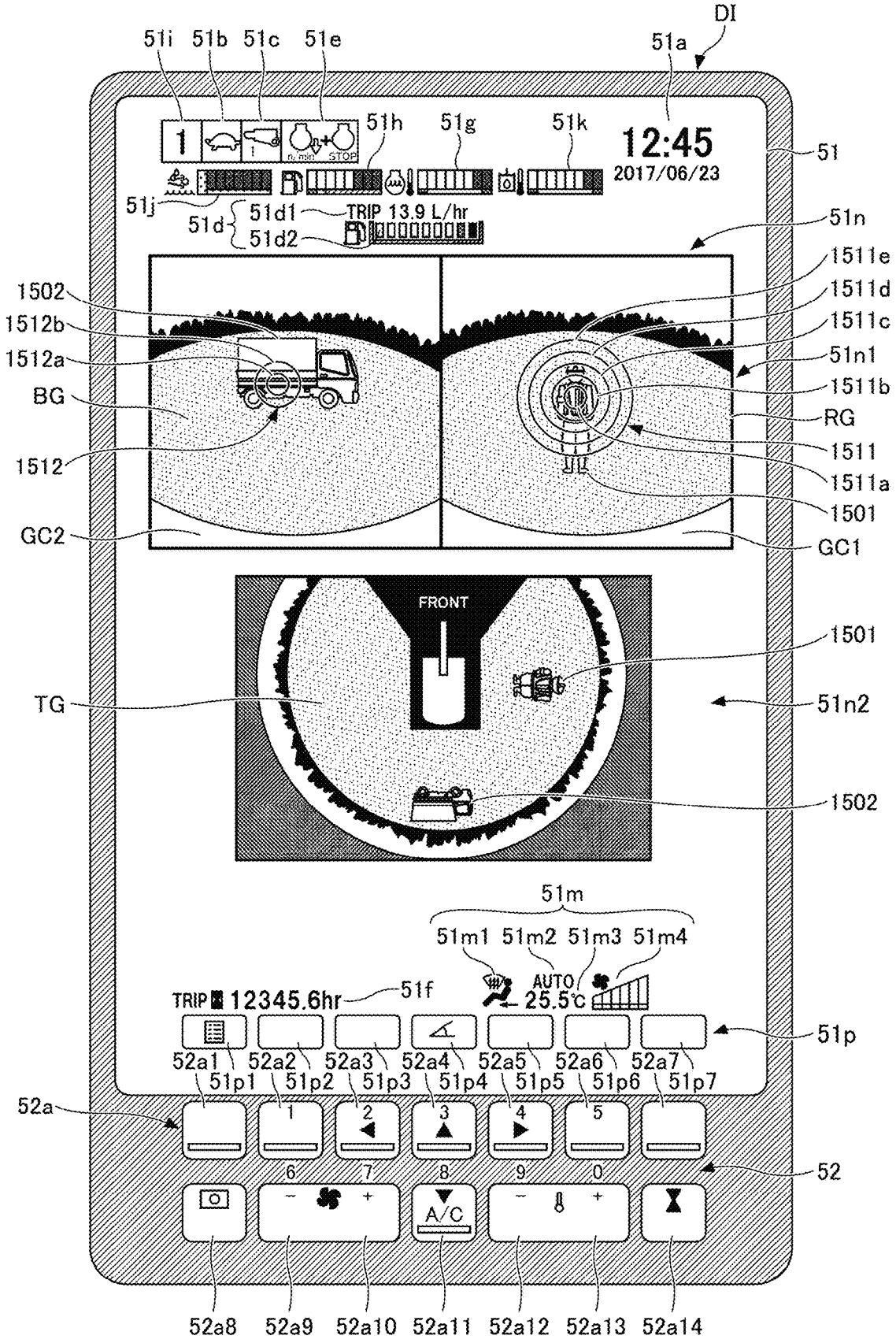
FIG. 17 is a diagram illustrating a configuration example of an image display section and an operation section of a display device of the shovel according to the even further another embodiment.

Next, a configuration example of an image display section 51 and an operation section 52 of the display device DI will be described with reference to FIG. 17. FIG. 17 is a diagram illustrating a configuration example of the image display section 51 and the operation section 52 of the display device DI. In the example illustrated in FIG. 17, a home screen including a right image RG, a rear image BG, and a bird's-eye view image TG is displayed on the image display section 51 as a screen displayed before a push switch 52*a* of the operation section 52 is operated. The home screen is displayed during the operation of the shovel 100.

First, the image display section 51 will be described. As illustrated in FIG. 17, the image display section 51 includes a date and time display area 51*a*, a driving mode display area 51*b*, an attachment display area 51*c*, a fuel consumption display area 51*d*, an engine control state display area 51*e*, an engine running time display area 51*f*, a cooling water temperature display area 51*g*, a fuel remaining amount display area 51*h*, a rotation speed level display area 51*i*, a urea water remaining amount display area 51*j*, a hydraulic fluid temperature display area 51*k*, an air conditioner operation state display area 51*m*, an image display area 51*n*, and a switch image display area 51*p*.

The driving mode display area 51*b*, the attachment display area 51*c*, the engine control state display area 51*e*, the rotation speed level display area 51*i*, and the air conditioner operation state display area 51*m* are areas for displaying setting state information that is information about the setting state of the shovel 100. The fuel consumption display area 51*d*, the engine running time display area 51*f*, the cooling water temperature display area 51*g*, the fuel remaining amount display area 51*h*, the urea water remaining amount display area 51*j*, and the hydraulic fluid temperature display area 51*k* are areas for displaying operating state information that is information about the operating state of the shovel 100.

Specifically, the date and time display area 51*a* is an area for displaying the current date and time. The driving mode display area 51*b* is an area for displaying the current driving mode. The attachment display area 51*c* is an area for displaying an image representing the currently installed attachment. The fuel consumption display area 51*d* is an area for displaying fuel consumption information calculated by the shovel controller 30. The fuel consumption display area 51*d* includes an average fuel consumption display area 51*d*1 for displaying lifetime average fuel consumption or section average fuel consumption, and an instantaneous fuel consumption display area 51*d*2 for displaying instantaneous fuel consumption.

The engine control state display area 51*e* is an area for displaying the control state of the engine 11. The engine running time display area 51*f* is an area for displaying the cumulative operation time of the engine 11. The cooling water temperature display area 51*g* is an area for displaying the current temperature state of the engine cooling water. The fuel remaining amount display area 51*h* is an area for displaying the remaining amount state of the fuel stored in the fuel tank. The rotation speed level display area 51*i* is an area for displaying an image of the current level set by a dial 75. FIG. 17 illustrates a state in which a first level is selected. The urea water remaining amount display area 51*j* is an area for displaying an image of the remaining amount state of the urea water stored in the urea water tank. The hydraulic fluid temperature display area 51*k* is an area for displaying the temperature state of the hydraulic fluid in the hydraulic fluid tank.

The air conditioner operation state display area 51*m* includes an outlet display area 51*m*1 for displaying the current outlet position, an operation mode display area 51*m*2 for displaying the current operation mode, a temperature display area 51*m*3 for displaying the current set temperature, and an air volume display area 51*m*4 for displaying the current set air volume.

The image display area 51*n* is an area for displaying an image captured by the imaging device S6. In the example illustrated in FIG. 17, the image display area 51*n* displays the right image RG, the rear image BG, and the bird's-eye view image TG.

The right image RG is an image of the space to the right of the shovel 100 and includes an image GC1 of the right end of the upper surface of the upper turning body 3. The right image RG is an image generated by the shovel controller 30 by superimposing a sound heat map generated from a sound signal acquired by the right microphone array A1R on an image captured by the right camera S6R.

A worker 1501 is seen in the right image RG. Further, a sound detection region 1511 represented by the sound heat map is superimposed on the right image RG. The sound detection region 1511 is a region displayed based on the sound heat map. The sound detection region 1511 includes a dark red region 1511*a*, a red region 1511*b*, an orange region 1511*c*, a yellow region 1511*d*, and a light yellow region 1511*e*.

The rear image BG is an image of the space to the rear of the shovel 100 and includes a counterweight image GC2. The rear image BG is an image generated by the shovel controller 30 by superimposing a sound heat map generated from a sound signal acquired by the rear microphone array A1B on an image captured by the rear camera S6B.

A truck 1502 is seen in the rear image BG. Further, a sound detection region 1512 represented by the sound heat map is superimposed on the rear image BG. The sound detection region 1512 is a region displayed based on the sound heat map. The sound detection region 1521 includes a yellow region 1512*a* and a light yellow region 1512*b*.

The bird's-eye view image TG is a virtual viewpoint image generated by the shovel controller 30, and is generated based on images acquired by the rear camera S6B, the left camera S6L, and the right camera S6R. In the center of the bird's-eye view image, a figure of a shovel corresponding to the shovel 100 is arranged. This allows the operator to more intuitively understand the positional relationship between the shovel 100 and objects around the shovel 100.

The worker 1501 and the truck 1502 are also illustrated in the bird's-eye view image TG. Thus, the operator of the shovel 100 can recognize the surrounding situation.

The image display area 51*n* includes a first image display area 51*n*1 located above and a second image display area 51*n*2 located below. In the example illustrated in FIG. 17, the right image RG and the rear image BG are arranged in the first image display area 51*n*1, and the bird's-eye view image TG is arranged in the second image display area 51*n*2. In the image display area 51*n*, the bird's-eye view image TG may be arranged in the first image display area 51*n*1, and the rear image BG and the right image RG may be arranged in the second image display area 51*n*2.

The image display area 51*n* may be configured to display the left image as well. In this case, in the image display area 51*n*, the left image and the right image RG may be arranged in the first image display area 51*n*1, and the rear image BG and the bird's-eye view image TG may be arranged in the second image display area 51*n*2. In this case, the left image may be arranged on the left side of the first image display area 51*n*1, and the right image RG may be arranged on the right side of the first image display area 51*n*1.

In the example illustrated in FIG. 17, the right image RG and the rear image BG may be arranged adjacent to each other on the right and left sides, but may be spaced apart. In the example illustrated in FIG. 17, the image display area 51*n* is a vertically long area, but the image display area 51*n* may be a horizontally long area. When the image display area 51*n* is a horizontally long area, in the image display area 51*n*, the bird's-eye view image TG may be arranged as the first image display area 51*n*1 on the left side, and the rear image BG and the right image RG may be arranged as the second image display area 51*n*2 on the right side. In this case, the images may be spaced left and right, and the position of the bird's-eye view image TG and the position of the rear image BG and the right image RG may be interchanged.

The switch image display area 51*p* includes switch images 51*p*1 to 51*p*7. In the example illustrated in FIG. 17, the switch images 51*p*1 to 51*p*7 are arranged at the bottom of the image display section 51 at left and right intervals from each other. The switch images 51*p*1 to 51*p*7 display icons representing the functions f the corresponding push switches 52*a*1 to 52*a*7.

On the switch image 51*p*1, a menu detail item icon for displaying menu detail items is displayed. When the operator operates the push switch 52*a*1 corresponding to the switch image 51*p*1, the icons displayed on the switch images 51*p*2 to 51*p*7 are switched to the icons associated with the menu detail items.

In the example illustrated in FIG. 17, an icon for displaying information about the digital level is displayed on the switch image 51*p*4. When the operator operates the push switch 52*a*4 corresponding to the switch image 51*p*4, the bird's-eye view image TG displayed in the second image display area 51*n*2 is switched to an image (sub-screen) indicating information about the digital level. Meanwhile, the rear image BG and the right image RG displayed in the first image display area 51*n*1 are continuously displayed in the same size. The image (sub-screen) indicating the information about the digital level may be displayed in the first image display area 51*n*1. In this case, the rear image BG and the right image RG displayed in the first image display area 51*n*1 may be displayed in the second image display area 51*n*2 instead of the bird's-eye view image TG.

In the example illustrated in FIG. 17, icons are not displayed in the switch images 51*p*2, 51*p*3, 51*p*5, 51*p*6, and 51*p*7. Therefore, even when the operator operates the push switches 52*a*2, 52*a*3, 52*a*5, 52*a*6, and 52*a*7 corresponding to the switch images 51*p*2, 51*p*3, 51*p*5, 51*p*6, and 51*p*7, no change occurs in the image displayed on the image display section 51.

The icons displayed on the switch images 51*p*1 to 51*p*7 are not limited to the above example, and icons for displaying other information may be displayed.

Next, the operation section 52 will be described. As illustrated in FIG. 17, the operation section 52 includes push 52*a* switches that are button-type switches corresponding to each of the switch images 51*p*1 to 51*p*7. In the example illustrated in FIG. 17, the operation section 52 includes seven push switches 52*a*1 to 52*a*7 arranged in the upper row and seven push switches 52*a*8 to 52*a*14 arranged in the lower row. The push switches 52*a*8 to 52*a*14 are arranged below each of the push switches 52*a*1 to 52*a*7. However, the number, configuration, and arrangement of the push switches 52*a* of the operation section 52 are not limited to the above example, and it may be in the form of a jog wheel, a jog switch, or the like, that combines the functions of multiple button-type switches into one. The operation section 52 may be formed as a member separate from the display device DI.

The switch images 51*p*1 to 51*p*7 may be directly touch-operated by a touch panel in which the image display section 51 and the operation section 52 are integrated.

The push switches 52*a*1 to 52*a*7 are arranged below the switch images 51*p*1 to 51*p*7, corresponding to the switch images 51*p*1 to 51*p*7, and function as push switches for selecting the switch images 51*p*1 to 51*p*7, respectively. Because the push switches 52*a*1 to 52*a*7 are arranged below the switch images 51*p*1 to 51*p*7 corresponding to the switch images 51*p*1 to 51*p*7, the operator can intuitively select the switch images 51*p*1 to 51*p*7.

The push switch 52*a*8 is a switch for switching the captured image displayed in the image display area 51*n*. Each time the push switch 52*a*8 is operated, the captured image displayed in the first image display area 51*n*1 of the image display area 51*n* is switched between, for example, the rear image, the left image, the right image, and the bird's-eye view image. Each time the push switch 52*a*8 is operated, the captured image displayed in the second image display area 51*n*2 of the image display area 51*n* may be switched between, for example, the rear image, the left image, the right image, and the bird's-eye view image. Each time the push switch 52*a*8 is operated, the captured image displayed in the first image display area 51*n*1 of the image display area 51*n* and the captured image displayed in the second image display area 51*n*2 may be switched. Thus, the push switch 52*a*8 as the operation section 52 may be used to switch the captured image displayed in the first image display area 51*n*1 or in the second image display area 51*n*2, or may be used to switch the captured image displayed in the first image display area 51*n*1 and the captured image displayed in the second image display area 51*n*2. A switch for switching the screen displayed in the second image display area 51*n*2 may be provided separately.

The push switches 52*a*9 and 52*a*10 are switches for adjusting the air volume of the air conditioner. In the example illustrated in FIG. 17, the air volume of the air conditioner decreases when the push switch 52*a*9 is operated, and increases when the push switch 52*a*10 is operated.

The push switch 52*a*11 is a switch for switching the cooling and heating functions on and off. In the example illustrated in FIG. 17, each time the push switch 52*a*11 is operated, the cooling and heating functions are switched on and off.

The push switches 52*a*12 and 52*a*13 are switches for adjusting the set temperature of the air conditioner. In the example illustrated in FIG. 17, the set temperature decreases when the push switch 52*a*12 is operated, and increases when the push switch 52*a*13 is operated.

The push switch 52*a*14 is a switch for switching the display of the engine running time display area 51*f*.

The push switches 52*a*2 to 52*a*6 and 52*a*9 to 52*a*13 are configured to allow input of numbers displayed on or near the respective switches. The push switches 52*a*3, 52*a*4, 52*a*5, and 52*a*11 are configured such that when a cursor is displayed in the image display area 51*n*, the cursor can be moved to the left, up, right, and down, respectively.

The functions assigned to the push switches 52*a*1 to 52*a*7 and 52*a*8 to 52*a*14 described above are examples, and other functions may be assigned.

As described above, when the push switch 52*a*1 corresponding to the switch image 51*p*1 is operated while the right image RG, the rear image BG, and the bird's-eye view image TG are displayed in the image display area 51*n*, new icons (icons representing the functions newly assigned to the push switches 52*a*1 to 52*a*7) are displayed on the switch images 51*p*2 to 51*p*7 while the right image RG and the rear image BG are displayed. Therefore, the operator can check the new icons while checking the right image RG and the rear image BG.

In the above example, when one of the push switches 52*a*1 to 52*a*7 corresponding to the switch images 51*p*2 to 51*p*7 is operated while the right image RG, the rear image BG, and the bird's-eye view image TG are displayed in the image display area 51*n*, the bird's-eye view image TG is switched to a menu image indicating information corresponding to the selected switch image. Thus, the menu image is displayed while the right image RG and the rear image BG are displayed. Accordingly, the operator can continue monitoring the surroundings (the rear and right spaces) even while the menu image is displayed. Therefore, the operator can operate the shovel 100 with the menu image displayed.

In the present embodiment, the sound detection regions are superimposed on the right image RG and the rear image BG included in the image display area 51*n* of the display device DI.

That is, in the present embodiment, the operator on the shovel 100 can visually check the situation in front of the shovel 100, and can recognize the source of the sound together with the sound heard from the front of the shovel 100.

However, the operator on the shovel 100 may have difficulty recognizing the source of the sound for areas that are not visible. Therefore, in the shovel controller 30 according to the present embodiment, the screen described above is displayed on the display device DI.

Accordingly, the operator of the shovel 100 can recognize the source of the sound around the shovel 100 even in an area that is not visible. For example, because the source of the sound can be recognized by referring to the right image RG and the rear image BG, the source of the sound currently being heard by the operator can be understood, and the operation corresponding to the heard sound can be performed. Therefore, safety can be improved.

<Action>

In the above-described embodiments and variations, the operator can recognize the source of the sound by visually checking the display image, and thus, it becomes easier to check the situation at the work site. Therefore, because the operator can perform the operation according to the situation at the work site, safety can be improved. Further, because the operator can perform the operation according to the situation at the work site, work efficiency can be improved.

In the above-described embodiments and variations, a case where a shovel is used as an example of a work machine has been described. However, the configuration described in the embodiments and variations is not limited to the example where the shovel is applied as the work machine, and for example, a crane, a forklift, and the like may be applied.

Although the embodiments presenting an example of a display device of a work machine, a work machine, and a remote operation system for the work machine have been described above, the present disclosure is not limited to the embodiments. Various changes, modifications, substitutions, additions, deletions, and combinations are possible within the scope of the claims, and these naturally fall within the technical scope of the claims.

What is claimed is:

1. A display device for use in a work machine, comprising a controller circuit configured to:

acquire image information captured by an imaging device provided in the work machine;

acquire information about a sound signal acquired by each of a plurality of sound collectors provided in the work machine; and display on a display section a sound generation situation around the work machine obtained based on the information about the sound signal acquired from each of the plurality of sound collectors, the sound generation situation being superimposed on the image information, wherein the controller circuit is further configured to display an intensity of a sound acquired from a direction corresponding to each region in the image information in a recognizable display manner, as the sound generation situation.

2. The display device of the work machine according to claim 1, wherein when the sound signal acquired from each of the plurality of sound collectors includes a plurality of sound sources, the controller displays the plurality of sound sources in a recognizable display manner.

3. The display device of the work machine according to claim 1, wherein when the sound signal is acquired from a direction outside an area in the image information, the controller circuit is configured to display that the sound signal is acquired from outside the area in the image information.

4. The display device of the work machine according to claim 1, wherein the controller circuit is configured to convert a voice included in the sound signal into text and displays the converted text on the display section.

5. The display device of the work machine according to claim 1, wherein the controller circuit is configured to perform filtering based on a predetermined condition on the sound signal acquired from each of the plurality of sound collectors and output the filtered sound signal.

6. The display device of the work machine according to claim 5, wherein the controller circuit is configured to perform filtering to attenuate a predetermined frequency component and output the filtered sound signal.

7. The display device of the work machine according to claim 6, wherein the controller circuit is configured to perform filtering to attenuate a sound signal generated from a driving source of the work machine.

8. The display device of the work machine according to claim 5, wherein the controller circuit is configured to switch whether filtering is performed according to, as the predetermined condition, an operation received from an operation device.

9. The display device of the work machine according to claim 5, wherein the controller circuit is configured to output the filtered sound signal from a speaker.

10. A work machine comprising:

an imaging device;

a plurality of sound collectors; and a control device including a controller circuit configured to: acquire image information from the imaging device; acquire a sound signal from each of the plurality of sound collectors; and output, to a display device, a sound generation situation around the work machine based on the sound signal acquired from each of the plurality of sound collectors, superimposed on the image information, wherein the controller circuit is further configured to output, to the display device, an intensity of a sound acquired from a direction corresponding to each region in the image information, as the sound generation situation.

11. The work machine according to claim 10, wherein the plurality of sound collectors are provided so as to acquire sound emitted from a range including an imaging area to be imaged by the imaging device.

12. A remote operation system for a work machine, the remote operation system comprising:

a work machine; and an information processing device for operating the work machine, wherein the work machine includes a first controller circuit configured to: acquire image information from an imaging device provided in the work machine, acquire a sound signal from each of a plurality of sound collectors provided in the work machine, and transmit the image information and information about the sound signal, the information processing device includes a second controller circuit configured to:

display, on a display device, a sound generation situation around the work machine based on the information about the sound signal, superimposed on the image information that is received, and the second controller circuit is further configured to display an intensity of a sound acquired from a direction corresponding to each region in the image information in a recognizable display manner, as the sound generation situation.

* * * * *